US008655247B2

(12) United States Patent
Fuchigami et al.

(10) Patent No.: US 8,655,247 B2
(45) Date of Patent: Feb. 18, 2014

(54) FIXING DEVICE AND IMAGE FORMING APPARATUS

(75) Inventors: Makoto Fuchigami, Kanagawa (JP); Kazutoshi Misonoo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 209 days.

(21) Appl. No.: 13/193,261

(22) Filed: Jul. 28, 2011

(65) Prior Publication Data

US 2012/0243920 A1 Sep. 27, 2012

(30) Foreign Application Priority Data

Mar. 25, 2011 (JP) ..... 2011-068764

(51) Int. Cl.
*G03G 15/20* (2006.01)

(52) U.S. Cl.
USPC ..... 399/329

(58) Field of Classification Search
USPC ..... 399/328, 329
See application file for complete search history.

(56) References Cited

U.S. PATENT DOCUMENTS

| | | | | |
|---|---|---|---|---|
| 6,049,691 | A * | 4/2000 | Abe et al. | 399/330 |
| 2002/0048713 | A1* | 4/2002 | Komoto et al. | 430/124 |
| 2007/0280756 | A1* | 12/2007 | Matsumoto | 399/329 |

FOREIGN PATENT DOCUMENTS

| | | |
|---|---|---|
| JP | A-04-328833 | 11/1992 |
| JP | A-06-149104 | 5/1994 |
| JP | A-09-292786 | 11/1997 |
| JP | A-2006-133294 | 5/2006 |
| JP | A-2008-064924 | 3/2008 |

OTHER PUBLICATIONS

U.S. Appl. No. 13/214,750 (Related Application).

* cited by examiner

*Primary Examiner* — David Gray
*Assistant Examiner* — Thomas Giampaolo, II
(74) *Attorney, Agent, or Firm* — Oliff PLC

(57) ABSTRACT

A fixing device includes a heat source, a roller being heated by the heat source, an endless belt that contacts the roller and rotates along with a rotation of the roller, a guiding portion that includes a first resin member being disposed inside the endless belt and guiding a rotation of the endless belt, a pressing portion that includes a second resin member being disposed inside the endless belt and pressing the endless belt on the roller, and a plate member that includes an elongated metal member of which the longitudinal direction is arranged to be parallel to a rotation axis of the roller, a first end and a second end of the elongated metal member in the transverse direction being unified with the first resin member and the second resin member, respectively, wherein the elongated metal member has a part facing the inner surface of the endless belt.

8 Claims, 21 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2011-68764 filed Mar. 25, 2011.

BACKGROUND

Technical Field

The present invention relates to a fixing device and an image forming apparatus.

SUMMARY

According to an aspect of the invention, there is provided a fixing device including: a heat source; a roller that is heated by the heat source; an endless belt that contacts the roller and rotates along with a rotation of the roller; a guiding portion that includes a first resin member being disposed inside the endless belt and guiding a rotation of the endless belt; a pressing portion that includes a second resin member being disposed inside the endless belt and pressing the endless belt on the roller; and a plate member that includes an elongated metal member of which the longitudinal direction is arranged to be parallel to a rotation axis of the roller, a first end and a second end of the elongated metal member in the transverse direction being unified with the first resin member and the second resin member, respectively, wherein the elongated metal member has a part facing the inner surface of the endless belt.

BRIEF DESCRIPTION OF THE DRAWINGS

Exemplary embodiments of the present invention will be described in detail based on the following figures, wherein.

DETAILED DESCRIPTION

Hereinafter, a fixing device and an image forming apparatus according to an exemplary embodiment of the invention, a molding machine used to manufacture a pressing member of the fixing device, and a method of manufacturing the pressing member as an insert-molded product will be described with reference to the accompanying drawings.

Entire Configuration

Figure 1:
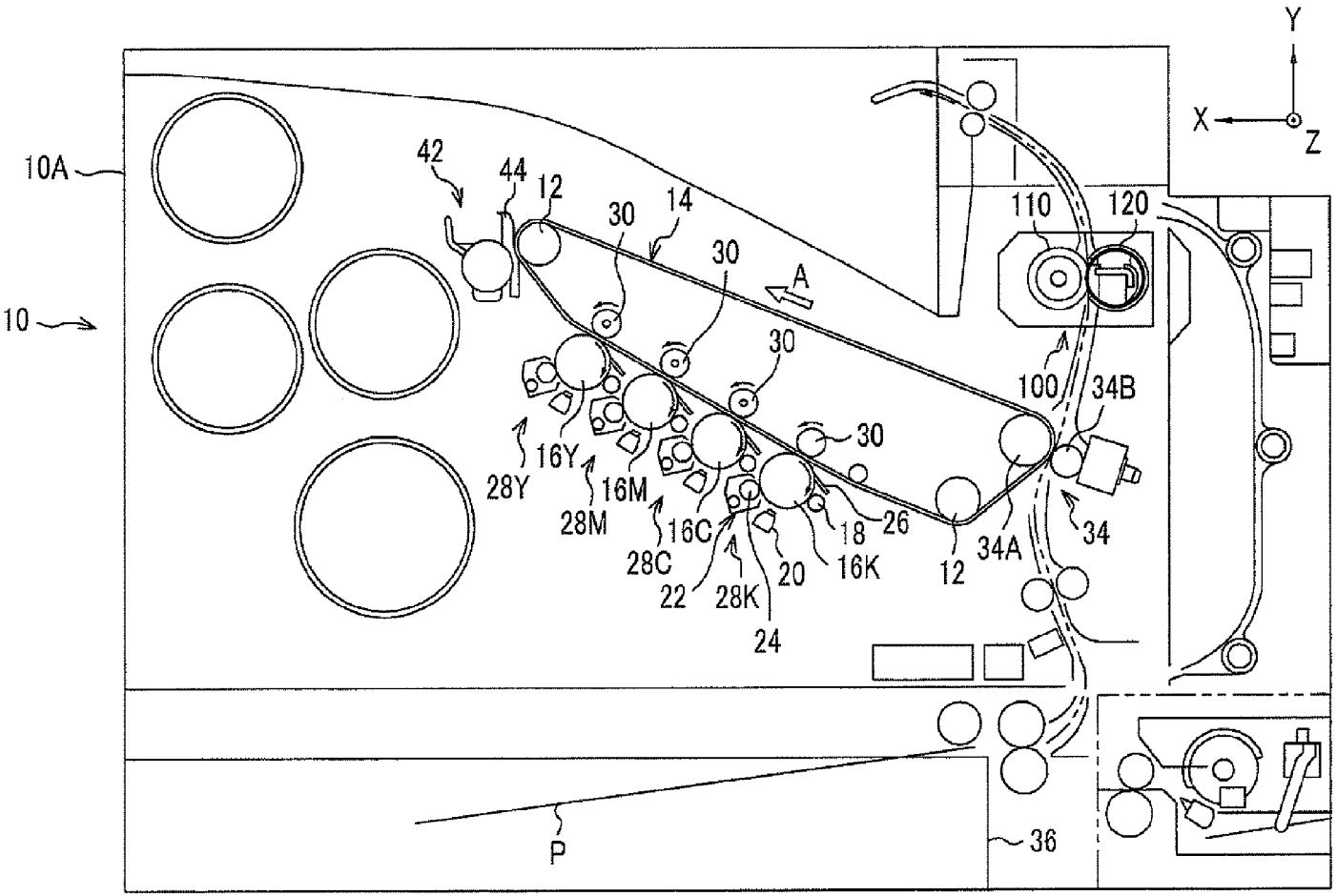
FIG. 1 is a diagram schematically illustrating the overall configuration of an image forming apparatus according to an exemplary embodiment of the invention.

FIG. 1 is a diagram illustrating an example of the configuration of an image forming apparatus having a fixing device according to an exemplary embodiment of the invention. In the following description, the vertical direction of an apparatus body 10A of the image forming apparatus 10 is defined as a direction of arrow Y, the horizontal direction thereof is defined as a direction of arrow X, and the depth direction thereof is defined as a direction of arrow Z.

As shown in FIG. 1, the apparatus body 10A of the image forming apparatus 10 is provided with an intermediate transfer belt 14 as an example of a transfer member having one endless belt shape, which is suspended by plural rollers 12 and which is carried in the direction of arrow A by a motor (not shown).

The image forming apparatus 10 copes with the formation of a color image and includes image forming units 28Y, 28M, 28C, and 28K that form toner images corresponding to four colors of yellow (Y), magenta (M), cyan (C), and black (K), respectively. The image forming units 28Y, 28M, 28C, and 28K are arranged in the carrying direction of the intermediate transfer belt 14 and are detachably supported by the apparatus body 10A.

Letters representing the colors (Y, M, C, and K) are added to tails of reference numerals of members disposed for the colors. Particularly, when it is not necessary to distinguish the colors from each other, the letters will not be added to the tails.

The image forming units 28Y, 28M, 28C, and 28K include photosensitive drums 16Y, 16M, 16C, and 16K, respectively, as an example of an image holding member rotating in the clockwise direction by a driving unit (not shown) including a motor and a gear.

A charging roller 18 uniformly charging the surface of each photosensitive drum 16 to a constant potential is disposed on the peripheral surface of the corresponding photosensitive drum 16. The charging roller 18 is a conductive roller, the peripheral surface thereof contacts the peripheral surface of the photosensitive drum 16, and the axis direction of the charging roller 18 is parallel to the axis direction of the photosensitive drum 16.

An LED print head (hereinafter, referred to as "LPH") 20 as an example of the exposing device is disposed on the peripheral surface downstream from the charging roller 18 in the rotating direction of each photosensitive drum 16. The LPH 20 has an elongated shape and disposed along the axis direction of the photosensitive drum 16. The LPH 20 includes an LED (Light Emitting Diode) array as a light source. The LPH 20 irradiates the corresponding photosensitive drum 16 with a light beam on the basis of image data to form an electrostatic latent image on the surface of the photosensitive drum 16.

A developing device 22 is disposed on the peripheral surface downstream from the LPH 20 in the rotating direction of each photosensitive drum 16. The developing device 22 serves to develop the electrostatic latent image formed on the surface of the photosensitive drum 16 with the toner of the corresponding color (yellow, magenta, cyan, or black) to form a toner image.

Specifically, the developing device 22 includes a cylindrical developing roller 24 rotatably disposed in the vicinity of the photosensitive drum 16. A developing bias is applied to the developing roller 24 and the toner filled in the developing device 22 is attached to the peripheral surface thereof. The toner attached to the developing roller 24 is transferred to the surface of the photosensitive drum 16 with the rotation of the developing roller 24, and the toner is rubbed on the photosensitive drum 16 to develop the electrostatic latent image formed on the surface of the photosensitive drum 16 as a toner image.

A transfer roller 30 as an example of the transfer device transferring the toner image on the corresponding photosensitive drum 16 to the intermediate transfer belt 14 is disposed on the peripheral surface downstream from the developing device 22 in the rotating direction of the photosensitive drum 16. The transfer roller 30 is charged to a constant potential, rotates in the counterclockwise direction to carry the intermediate transfer belt 14 at a constant speed, and presses the intermediate transfer belt 14 against the photosensitive drum 16. Accordingly, the toner image on the surface of the corresponding photosensitive drum 16 is transferred onto the intermediate transfer belt 14.

A cleaning blade 26 is disposed on the peripheral surface downstream from the transfer roller 30 in the rotating direction of each photosensitive drum 16. The cleaning blade 26 is disposed so that one end thereof contacts the surface of the photosensitive drum 16 and serves to clean and recover the toner not transferred to the intermediate transfer belt 14 and remaining on the photosensitive drum 16 or the toner of other colors attached to the photosensitive drum 16 at the time of transfer.

The toner images formed by the image forming units 28 are transferred to the belt surface of the intermediate transfer belt 14 to overlap with each other on the belt surface. Accordingly, a colorful toner image is formed on the intermediate transfer belt 14. The toner image formed by repeatedly transferring the toner images of four colors in this way is referred to as a "final toner image".

A secondary transfer device 34 including two opposed rollers 34A and 34B is disposed downstream from four photosensitive drums 16 in the carrying direction of the intermediate transfer belt 14. The secondary transfer device 34 serves to transfer the final toner image formed on the intermediate transfer belt 14 to a recording sheet of paper P picked up from a paper tray 36 disposed on the bottom of the image forming apparatus 10 and carried between the rollers 34A and 34B.

The carrying path of the recording sheet of paper P to which the final toner image has been transferred is provided with a fixing device 100. The fixing device 100 includes a heating roller 110 and a pressing roller 120. The recording sheet of paper P carried to the fixing device 100 is pinched and carried by the heating roller 110 and the pressing roller 120. Accordingly, the toner on the recording sheet of paper P is melted and pressed on the recording sheet of paper P and the final toner image is fixed to the recording sheet of paper P.

On the other hand, on the outer peripheral surface of the intermediate transfer belt 14, a cleaner device 42 recovering the toner remaining on the intermediate transfer belt 14 without being transferred to the recording sheet of paper P by the secondary transfer device 34 is disposed downstream from the secondary transfer device 34 in the carrying direction of the intermediate transfer belt 14. The cleaner device 42 includes a blade 44 coming in contact with the intermediate transfer belt 14 and recovers the toner remaining on the intermediate transfer belt 14 by rubbing off the toner.

The image forming apparatus 10 having the above-mentioned configuration forms an image as follows.

First, the surface of the photosensitive drum 16 is uniformly charged to minus by the charging roller 18. Then, the charged surface of the photosensitive drum 16 is exposed to light by the LPH 20 on the basis of image data to be printed and an electrostatic latent image is formed on the surface of the photosensitive drum 16.

When the electrostatic latent image on the surface of the photosensitive drum 16 passes through the developing roller 24 of the developing device 22, the toner is attached to the electrostatic latent image by an electrostatic force and thus the electrostatic latent image is visualized as a toner image.

The visualized toner images of the colors are sequentially transferred to the intermediate transfer belt 14 by the transfer roller 30 and a colorful final toner image is formed on the intermediate transfer belt 14.

The final toner image on the intermediate transfer belt 14 is carried between the rollers 34A and 34B of the secondary transfer device 34 and the final toner image is transferred to a recording sheet of paper P which is picked up from the paper tray 36 and carried between the rollers 34A and 34B.

The toner image transferred to the recording sheet of paper P is fixed as a permanent image by the fixing device 100. The recording sheet of paper P passing through the fixing device 100 is discharged from the apparatus.

Configuration of Fixing Device 100

The fixing device 100 will be described below in detail.

Figure 2:
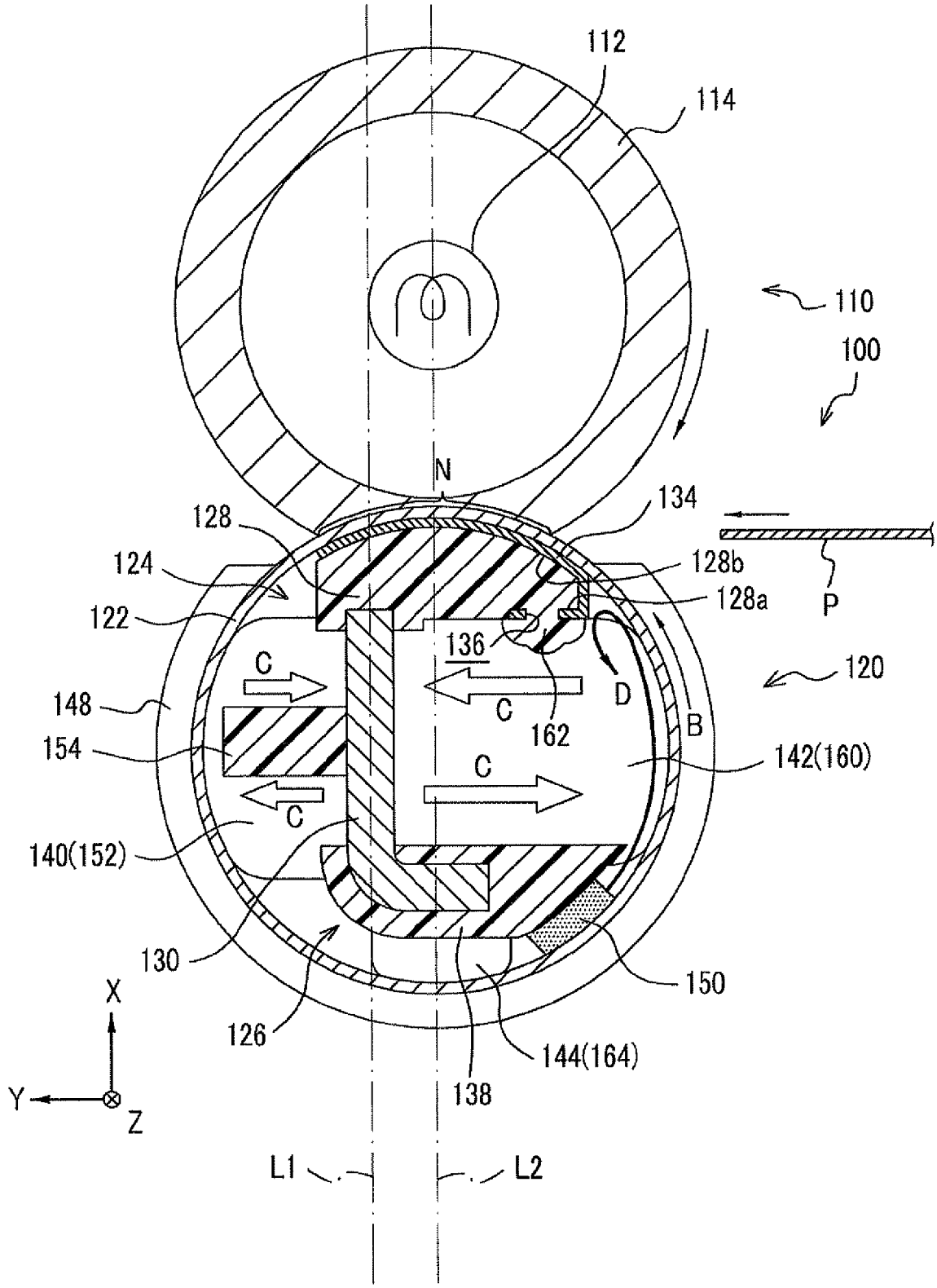
FIG. 2 is a sectional view illustrating the configuration of a fixing device according to the exemplary embodiment of the invention.

As shown in FIG. 2, the fixing device 100 includes a heating roller 110 and a pressing roller 120 as an example of a roller. The heating roller 110 includes a halogen lamp 112 as an example of a heat source at the center thereof. The halogen lamp 112 has an elongated shape and is disposed so that the longitudinal direction thereof is parallel to the direction of arrow Z. A roller portion 114 of the heating roller 110 is heated by heat emitted from the halogen lamp 112. The roller portion 114 is configured to rotate by a drive source (not shown) such as a motor. That is, the heating roller 110 is configured as a rotatable driving roller having a heat source.

The pressing roller 120 includes one endless belt 122 rotating by the rotation of the roller portion 114 of the heating roller 110 (with the rotation of the roller portion 114) and a pressing member 124 disposed inside the endless belt 122 so as to guide the rotational movement of the endless belt 122 and to press the endless belt 122 against the heating roller 110.

The pressing member 124 is urged to the heating roller 110 in the direction of arrow X by an urging member (not shown) such as a spring disposed at both ends in the direction of arrow Z, and presses the endless belt 122 against the heating roller 110 by the urging force thereof. By allowing the pressing member 124 to press the endless belt 122 against the heating roller 110, a nip part N pinching and carrying a recording sheet of paper P and fixing the toner to the recording sheet of paper P is formed between the endless belt 122 and the heating roller 110. The heat of the heating roller 110 is transmitted to the endless belt 122 via the nip part N.

The pressing member 124 includes a guiding portion 126 guiding the rotational movement of the endless belt 122, a pressing portion 128 pressing the endless belt 122 against the heating roller 110, and a metal plate 130 as an example of the plate member formed of, for example, a steel material so as to hold the guiding portion 126 and the pressing portion 128.

Figure 3:
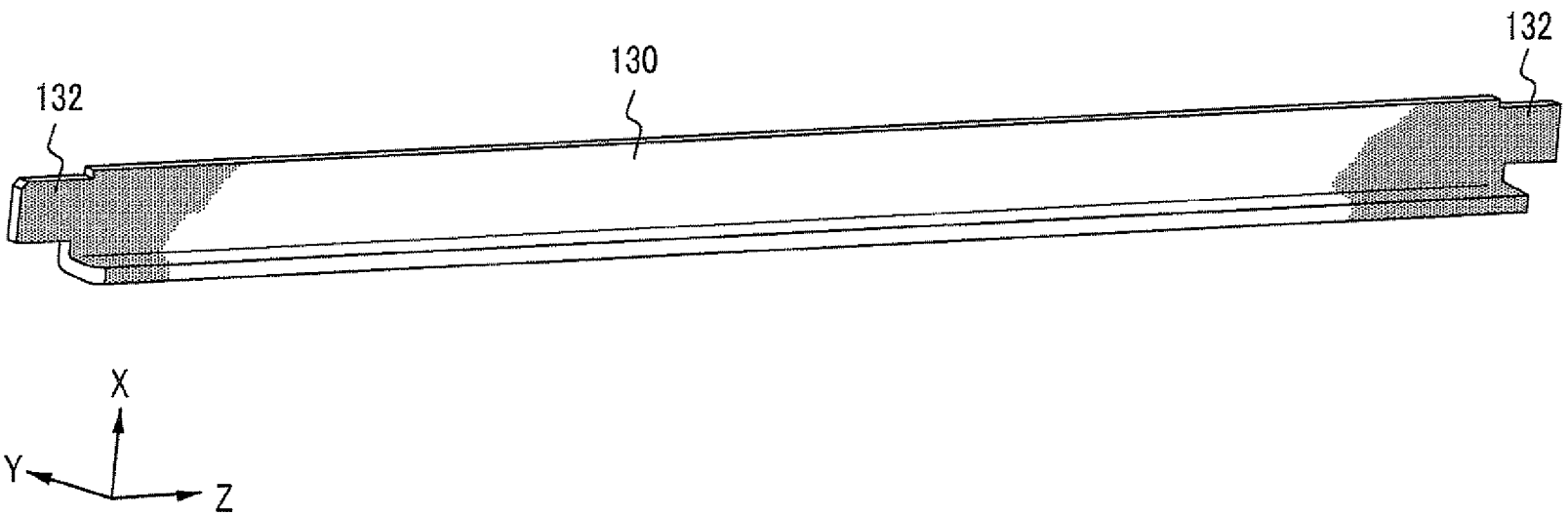
FIG. 3 is a perspective view illustrating a metal plate of a pressing member of the fixing device according to the exemplary embodiment of the invention.

As shown in FIG. 3, the metal plate 130 has a rectangular elongated shape in the direction of arrow Z and one end in the transverse direction (the direction of arrow X) is bent at right angle to form an L shape. Protrusions 132 protruding outwardly in the longitudinal direction are formed at both ends in the longitudinal direction of the metal plate 130. An end of the urging member is attached to the protrusions 132.

As shown in FIG. 2, the longitudinal direction of the metal plate 130 is parallel to the rotation axis direction (the direction of arrow Z) of the heating roller 110. The metal plate 130 holds the pressing portion 128 at one end in the transverse direction and holds the guiding portion 126 at the other end.

A sheet member 134 is disposed between the pressing portion 128 and the inner peripheral surface of the endless belt 122. The sheet member 134 is formed of, for example, polytetrafluoroethylene (PTFE) and serves to reduce the sliding resistance of the endless belt 122 in the nip part N.

Figure 4:
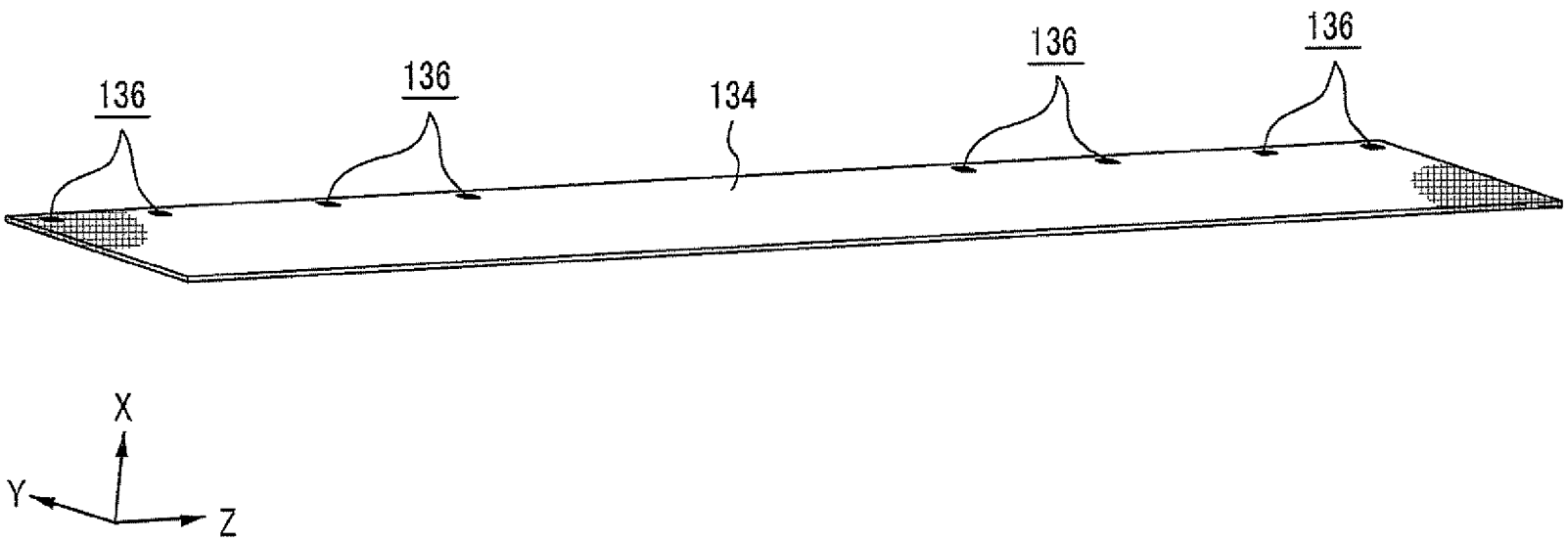
FIG. 4 is a perspective view illustrating a sheet member of the pressing member of the fixing device according to the exemplary embodiment of the invention.

As shown in FIG. 4, the sheet member 134 has a thin sheet shape and has flexibility. An end in the transverse direction (the direction of arrow Y) of the sheet member 134 is provided with plural (for example, eight) through-holes 136 formed along the longitudinal direction (the direction of arrow Z). As shown in FIG. 2, the sheet member 134 is locked to the inside surface 128*a* of the pressing portion 128 by locking portions 162 (to be described later) communicating with the through-holes 136 and is bent back along the outside surface 128*b* of the pressing portion 128, so that the most thereof is disposed between the pressing portion 128 and the inner peripheral surface of the endless belt 122.

Figure 5:
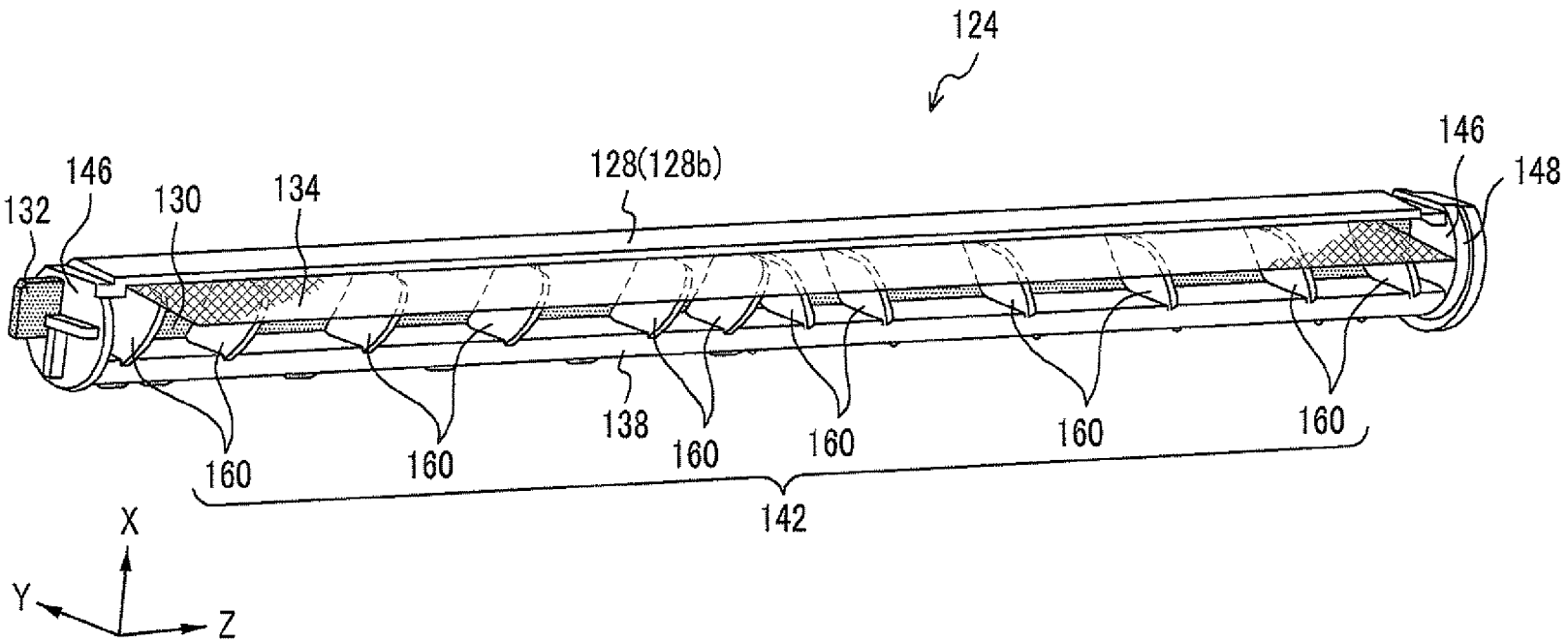
FIG. 5 is a perspective view illustrating the pressing member of the fixing device according to the exemplary embodiment of the invention.
Figure 6:
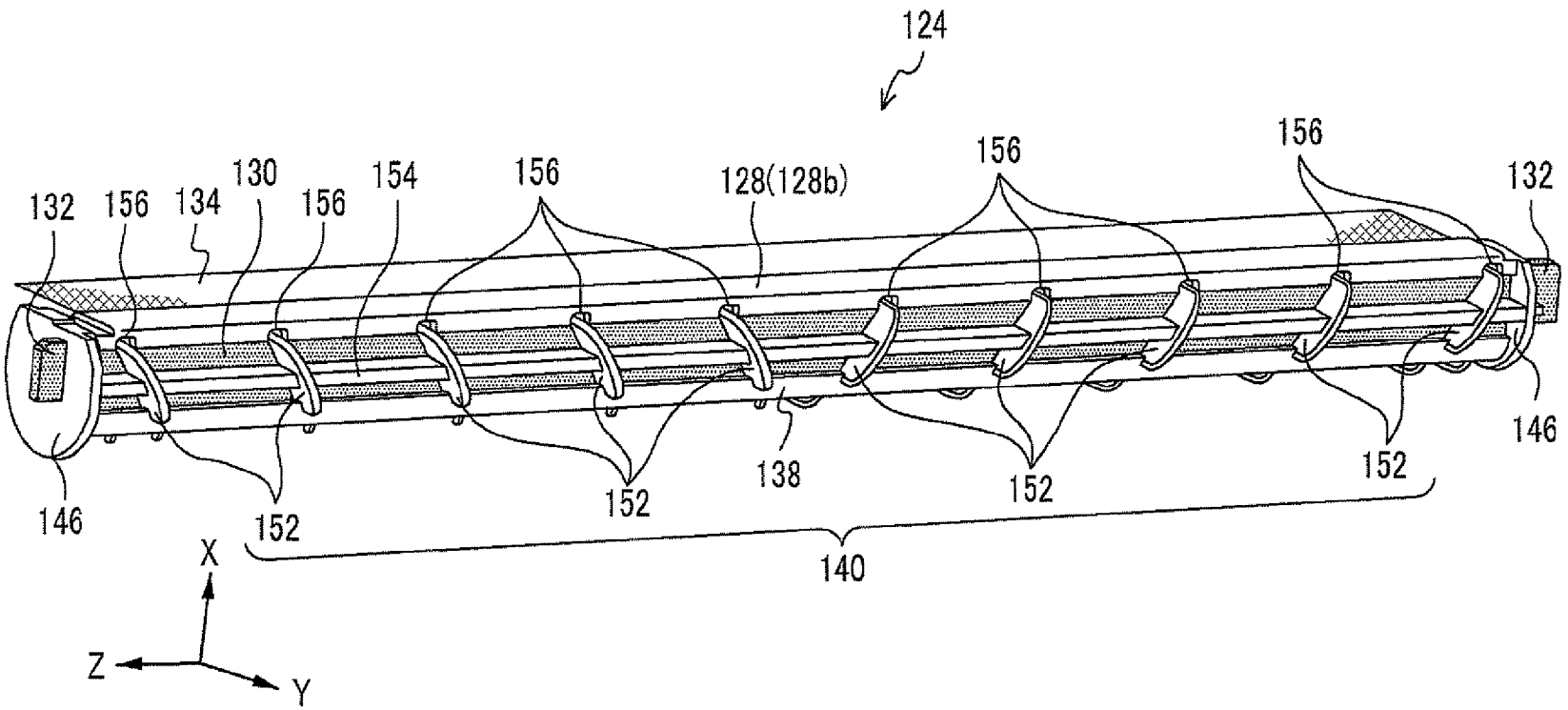
FIG. 6 is a perspective view illustrating the pressing member of the fixing device according to the exemplary embodiment of the invention when seen from the opposite side to FIG. 5.

As shown in FIGS. 2, 5, and 6, the pressing portion 128 has an elongated shape and is disposed at one end in the transverse direction of the metal plate 130 so that the longitudinal direction thereof is parallel to the longitudinal direction of the metal plate 130.

As shown in FIGS. 2 to 10, the guiding portion 126 includes an elongated portion 138 attached to the other end in the transverse direction of the metal plate 130 so as to be parallel to the longitudinal direction of the metal plate 130, a first rib group 140 as an example of the plural ribs being connected to the elongated portion 138 and extending toward the pressing portion 128, a second rib group 142 being disposed on the side opposite to the first rib group 140 with the metal plate 130 interposed therebetween, being connected to the elongated portion 138, and extending toward the pressing portion 128, and a third rib group 144 protruding outward from the elongated portion 138 to the opposite side of the pressing portion 128 in the direction of arrow X.

As shown in FIGS. 5 and 6, the pressing portion 128 and the elongated portion 138 are connected to each other by side portions 146 at both ends in the longitudinal direction (the direction of arrow Z). The side portions 146 have a substantially circular shape when seen in the direction of arrow Z and one of the side portions 146 includes an extension portion 148 extending from the outer periphery thereof so as to define the position in the direction of arrow Z of the endless belt 122 as shown in FIG. 2. The endless belt 122 is fitted to the pressing member 124 shown in FIGS. 5 and 6 from the other side portion 146 (the sheet member 134 is bent back along the outside surface 128*b* of the pressing portion 128 at the time of fitting the endless belt 122) and a cap member (not shown) having the same shape as the extension portion 148 is inserted into the other side portion 146, whereby the endless belt 122 does not depart from the pressing member 124.

The pressing portion 128, the elongated portion 138, the first rib group 140, the second rib group 142, the third rib group 144, and the side portions 146 are formed of a resin material such as polyethylene terephthalate (PET). The pressing member 124 is an insert-molded product in which the metal plate 130 and the sheet member 134 are unified with the resin material by injecting the resin material (molten resin) in a state where the metal plate 130 and the sheet member 134 are set into a cavity 302 of a mold 304 as described later.

As shown in FIG. 2, a nonwoven fabric (felt) 150 is disposed along the direction of arrow Z at a position of the elongated portion 138 facing the inner peripheral surface of the endless belt 122. Lubricant is infiltrated into the nonwoven fabric 150 and the lubricant is fed from the nonwoven fabric 150 by the rotational movement of the endless belt 122 in contact with the nonwoven fabric 150. The lubricant is widely spread on the inner peripheral surface of the endless belt 122, whereby the sliding resistance of the endless belt 122 is reduced and the endless belt 122 rotationally moves smoothly.

Figures 8A, 8B, 8C:
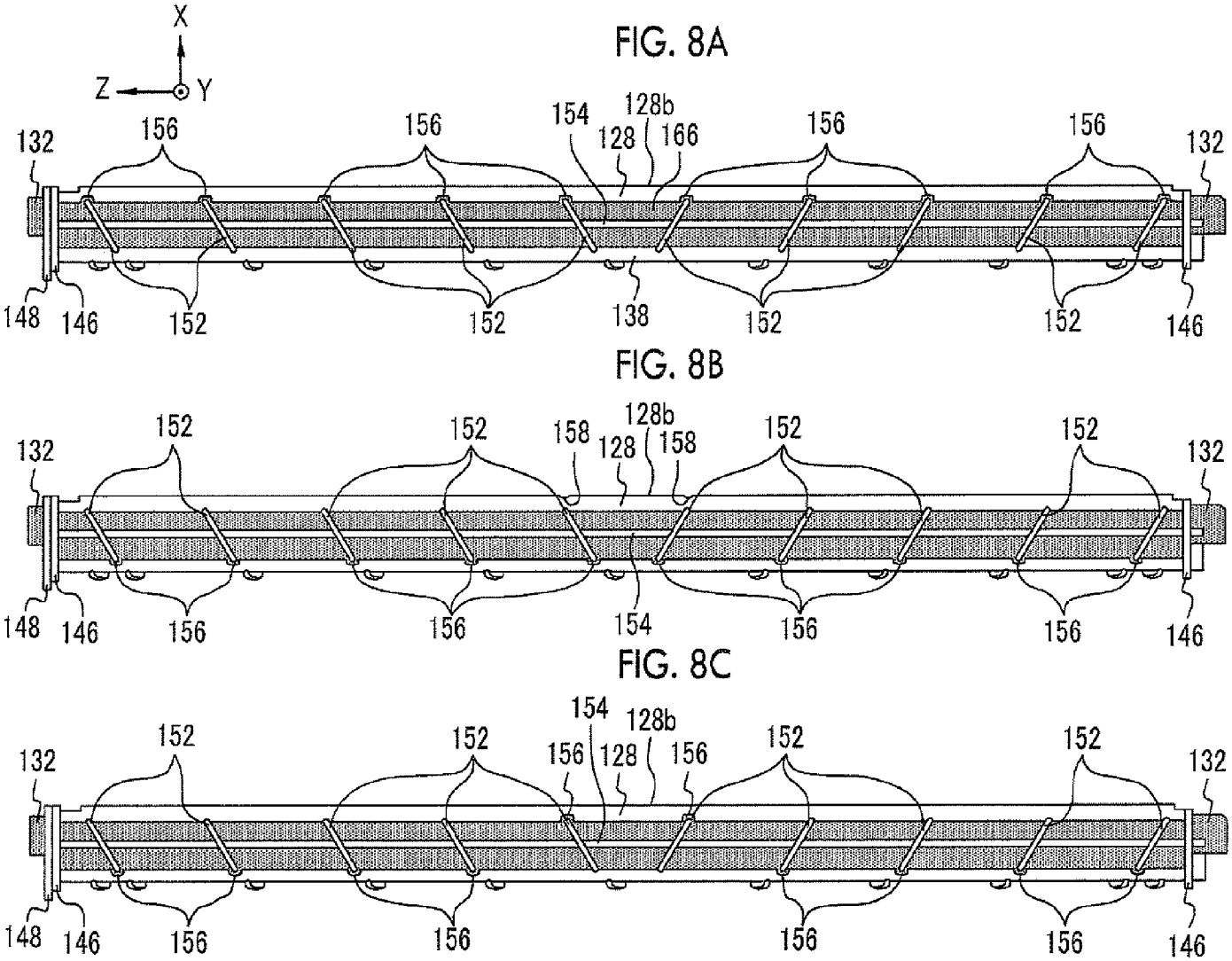
FIG. 8A is a top view illustrating the pressing member of the fixing device according to the exemplary embodiment of the invention and FIGS. 8B and 8C are top views illustrating the pressing member including a first rib group having a shape other than the shape of the first rib group shown in FIG. 8A.
Figure 9:
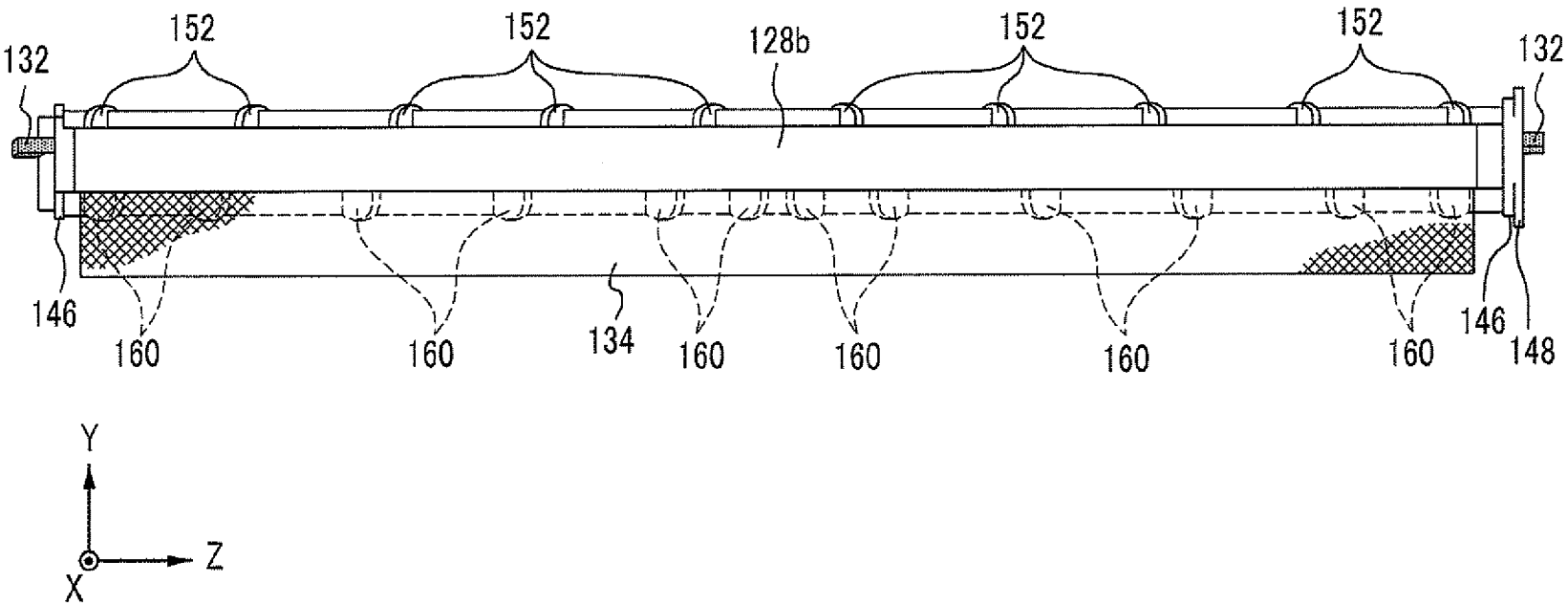
FIG. 9 is a side view illustrating the pressing member of the fixing device according to the exemplary embodiment of the invention when seen from a pressing portion.

As shown in FIGS. 2, 6, and 8A, the first rib group 140 includes plural (for example, ten) ribs 152 located downstream from the nip part N in the rotating direction of the endless belt and disposed at intervals in the longitudinal direction (the direction of arrow Z) of the metal plate 130. The ribs 152 of the first rib group 140 extend in the direction of arrow Y from the metal plate 130. The tips thereof have a circular arc shape so as to guide the rotational movement of the endless belt 122 when seen in the direction of arrow Z. A connection portion 154 connecting the ribs 152 is formed in the first rib group 140.

The ribs 152 of the first rib group 140 are connected to the elongated portion 138 and extend toward the pressing portion 128, but is not connected to the pressing portion 128. Specifically, a relief groove 156 is formed in the pressing portion 128 so as not to contact the ribs 152 of the first rib group 140.

As shown in FIG. 8B, as another example of the first rib group 140 shown in FIG. 8A, the ribs 152 of the first rib group 140 may be connected to the pressing portion 128 but may not be connected to the elongated portion 138 by forming a relief groove 156 in the elongated portion 138.

Figure 13:
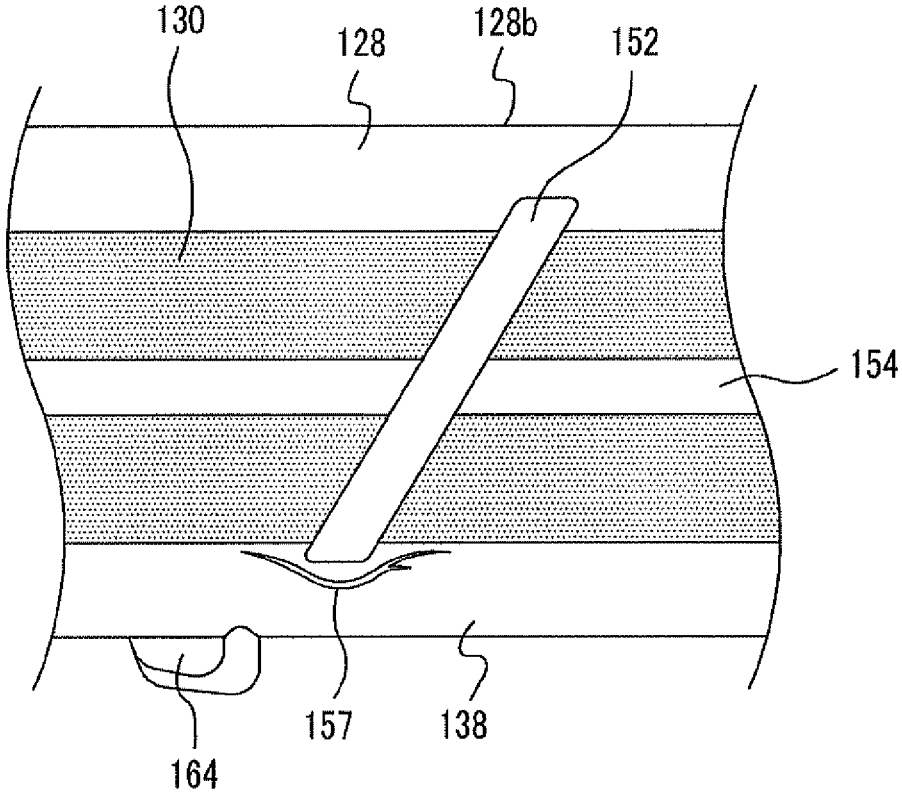
FIG. 13 is a diagram illustrating cracks formed in a connection base end of a rib in the pressing member having a configuration in which the ribs of the first rib group are connected to both the elongated portion and the pressing portion as a comparative example of the pressing member of the fixing device according to the exemplary embodiment of the invention.

The reason for the configuration in which the ribs 152 of the first rib group 140 are connected to one of the pressing portion 128 and the elongated portion 138 but not connected to the other thereof is as follows. That is, when the ribs 152 of the first rib group 140 are connected to both the pressing portion 128 and the elongated portion 138 as shown in FIG. 13, thermal distortion due to the difference in thermal expansion between the pressing portion 128 and the elongated portion 138 at a heating cycle of the fixing device 100 acts on the ribs 152 and cracks 157 are generated in connection base ends of the ribs 152.

As shown in FIG. 8B, when the ribs 152 of the first rib group 140 are connected to the pressing portion 128, thermally-contracted marks (sink marks) 158 are formed at positions corresponding to the rib-connection positions at the center in the direction of arrow Z on the outside surface 128*b* of the pressing portion 128. This is because the thickness of the pressing portion 128 at the center in the longitudinal direction (the direction of arrow Z) is larger than that at the ends (Here, the thickness is a thickness in the direction of arrow X. Although the thickness difference between the center and the ends is very small and thus is not clearly shown in the drawings, the outside surface 128*b* of the pressing portion 128 has a profile in which the center is curved convex in the thickness direction) and the thermal contraction at the time of insert-molding at the positions corresponding to the rib-connection positions of the outside surface 128*b* of the pressing portion 128 is larger at the center than that at the ends. When the thermally-contracted marks 158 are formed in the outside surface 128*b* of the pressing portion 128, a pressing force pressing the endless belt 122 against the heating roller 110 is lowered, which causes the deterioration in fixing performance of the fixing device 100.

In order not to cause the thermally-contracted marks 158 in the outside surface 128*b* of the pressing portion 128, the connection type shown in FIG. 8A is more preferable than the connection type shown in FIG. 8B as the connection type of the ribs 152 of the first rib group 140. As shown in FIG. 8C, a connection type may be employed in which only the ribs 152 at the center among the ribs 152 of the first rib group 140 are connected to the elongated portion 138 but are not connected to the pressing portion 128.

Figure 7:
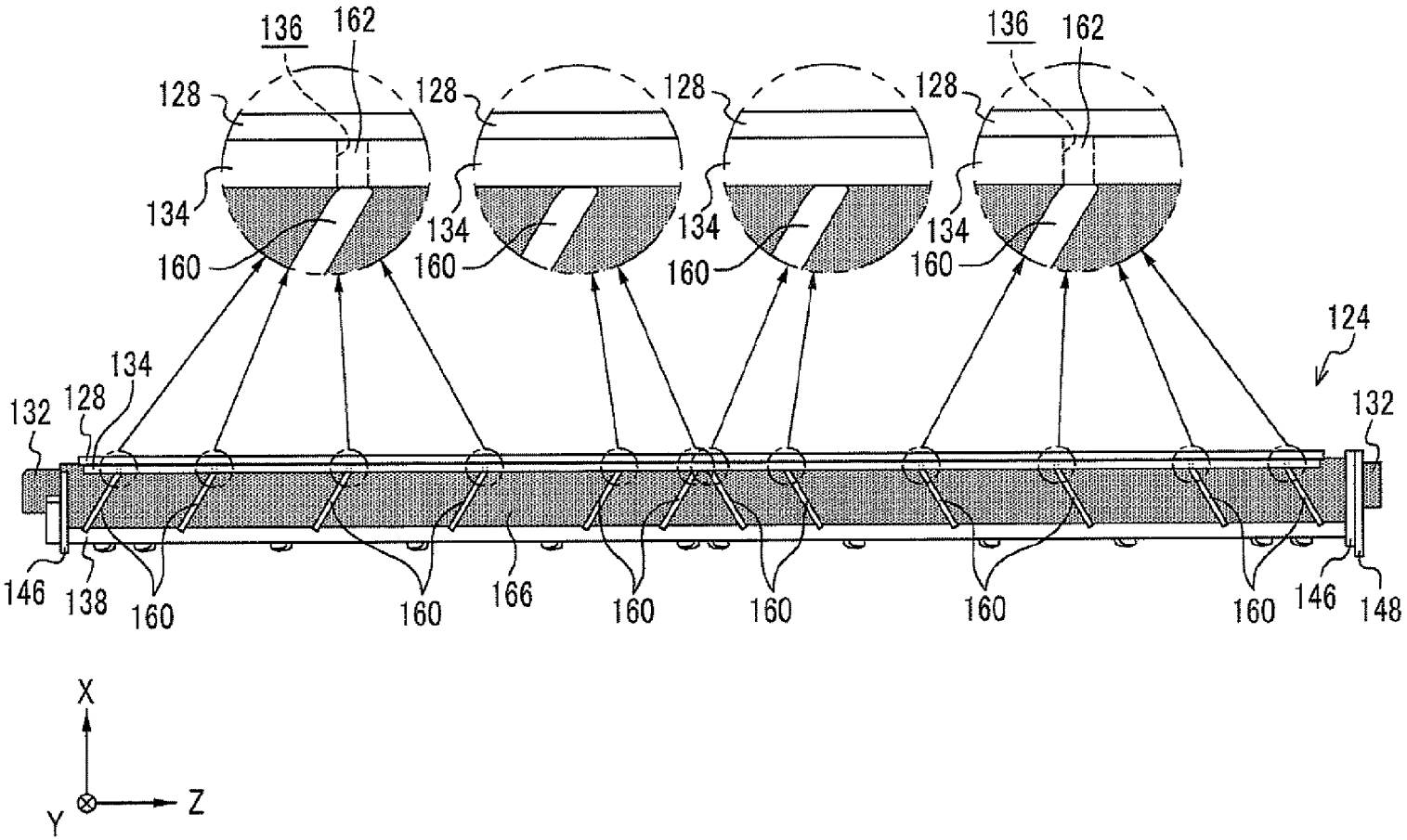
FIG. 7 is a bottom view illustrating the pressing member of the fixing device according to the exemplary embodiment of the invention.

As shown in FIGS. 2, 5, and 7, the second rib group 142 includes plural (for example, 12) ribs 160 arranged at intervals in the longitudinal direction (the direction of arrow Z) of the metal plate 130. The ribs 160 of the second rib group 142 are formed to extend from the metal plate 130 in the direction of arrow Y. The tips thereof have a circular arc shape so as to guide the rotational movement of the endless belt 122 when seen in the direction of arrow Z.

Four ribs 160 at the center in the direction of arrow Z among the 12 ribs 160 are connected to the elongated portion 138 and extend toward the pressing portion 128 but are not connected to the pressing portion 128. The other eight ribs 160 on both sides thereof are connected to the elongated portion 138, extend to the pressing portion 128, and are connected to the pressing portion 128 via pillar-like locking portions 162. The locking portions 162 communicate with the corresponding through-holes 136 of the sheet member 134 and thus the sheet member 134 does not depart from between the ribs 160 and the inside surface 128*a* of the pressing portion 128. In other words, the pressing member 124 is insert-molded so that one end in the transverse direction of the sheet member 134 is held between the ribs 160 of the second rib group 142 and the pressing portion 128.

The reason for not providing the locking portions 162 for the four ribs 160 at the center in the second rib group 142 is as follows. That is, as described with reference to FIG. 8B, this is because it is intended not to cause the thermally-contracted marks (sink marks) 158 in the outside surface 128*b* of the pressing portion 128.

Figure 10:
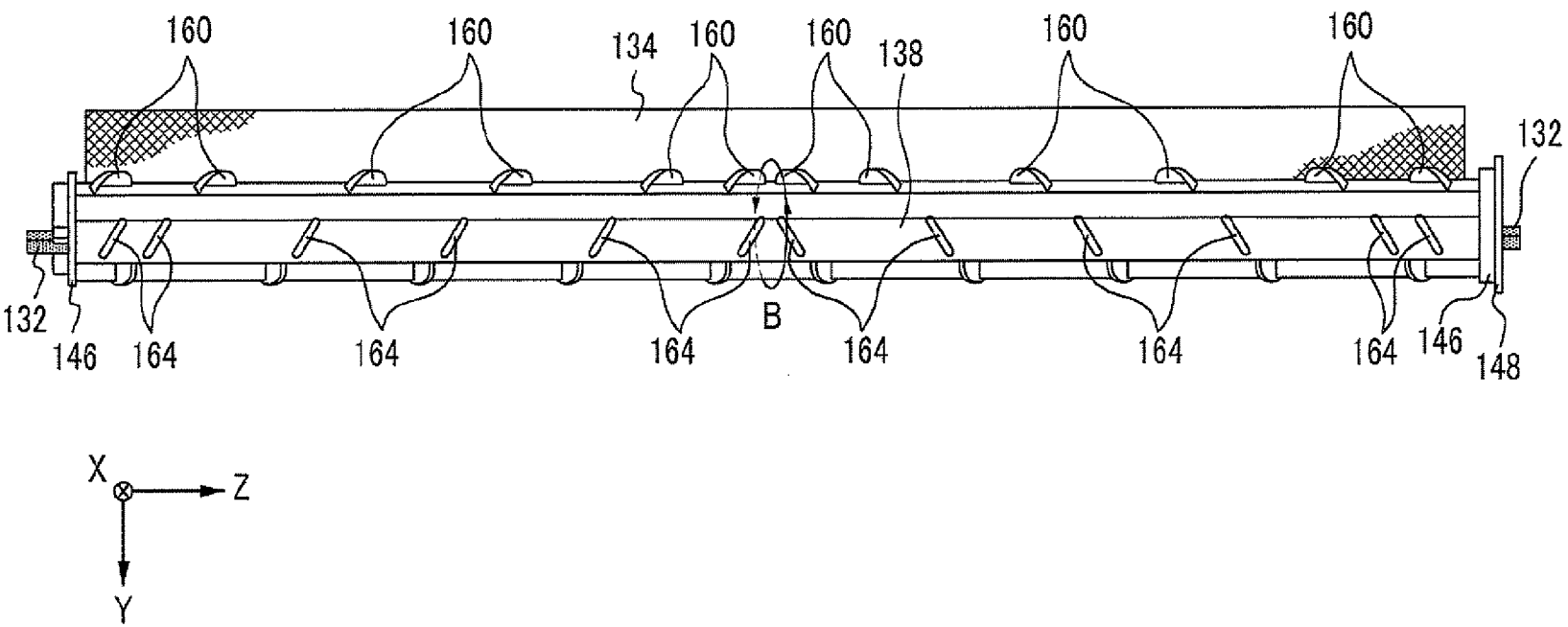
FIG. 10 is a side view illustrating the pressing member of the fixing device according to the exemplary embodiment of the invention when seen from an elongated portion.

As shown in FIGS. 2 and 10, the third rib group 144 includes plural (for example, 12) ribs 164 arranged at intervals in the longitudinal direction (the direction of arrow Z) of the elongated portion 138. The tips of the ribs 164 of the third rib group 144 have a circular arc shape so as to guide the rotational movement of the endless belt 122 when seen in the direction of arrow Z.

As shown in FIG. 10, the ribs 152, 160, and 164 of the first rib group 140, the second rib group 142, and the third rib group 144 are symmetric about the center in the longitudinal direction and are arranged in "A" shape when seen in the rotating direction B of the endless belt 122 as an upward direction. This is intended to feed the lubricant to the center in the direction of arrow Z inside the endless belt 122 with the rotational movement of the endless belt 122 and to prevent the lubricant from leaking from the gap in the side portions 146.

Figure 11A:
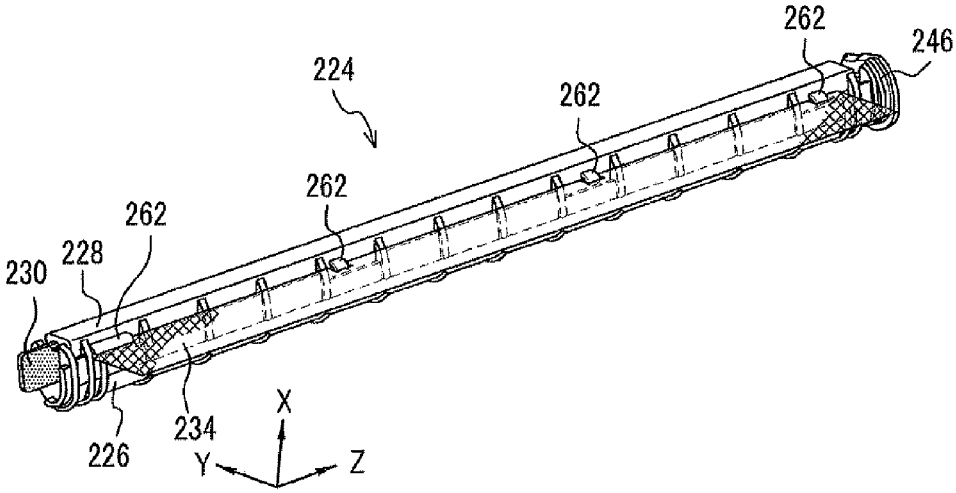
FIG. 11A is a perspective view illustrating a pressing member as a comparative example of the pressing member of the fixing device according to the exemplary embodiment of the invention and FIG. 11B is an exploded perspective view thereof.
Figure 11B:
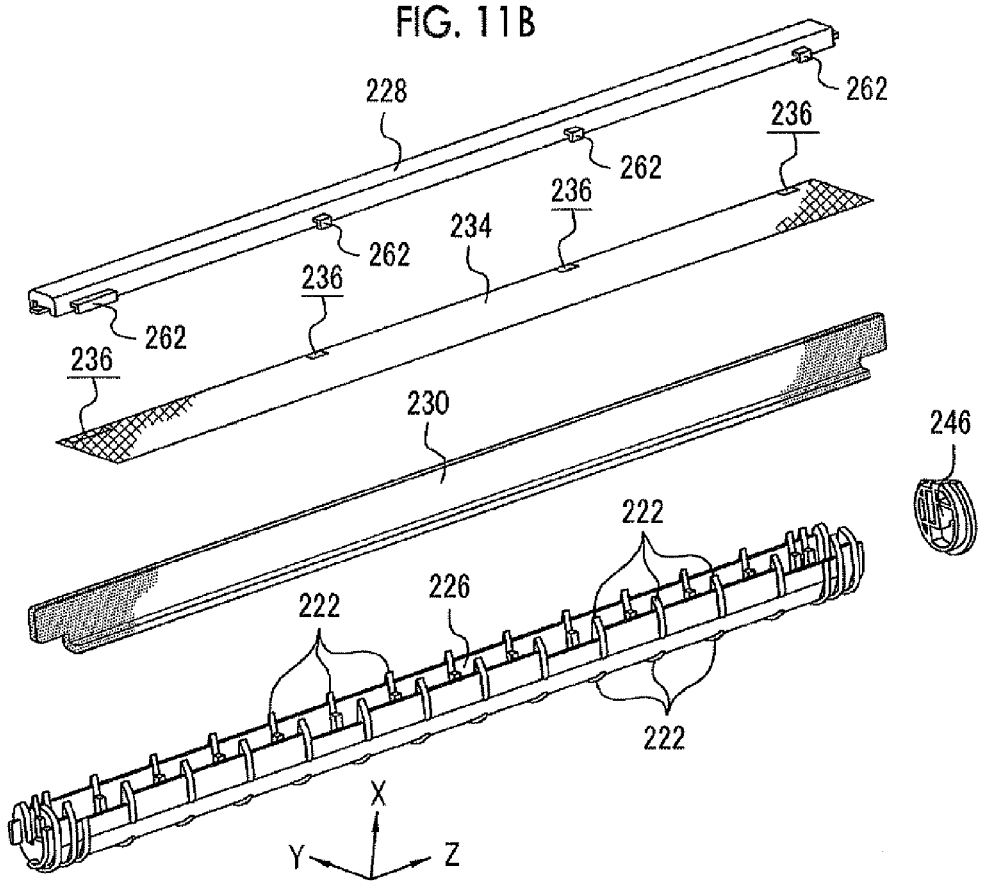
Figure 12:
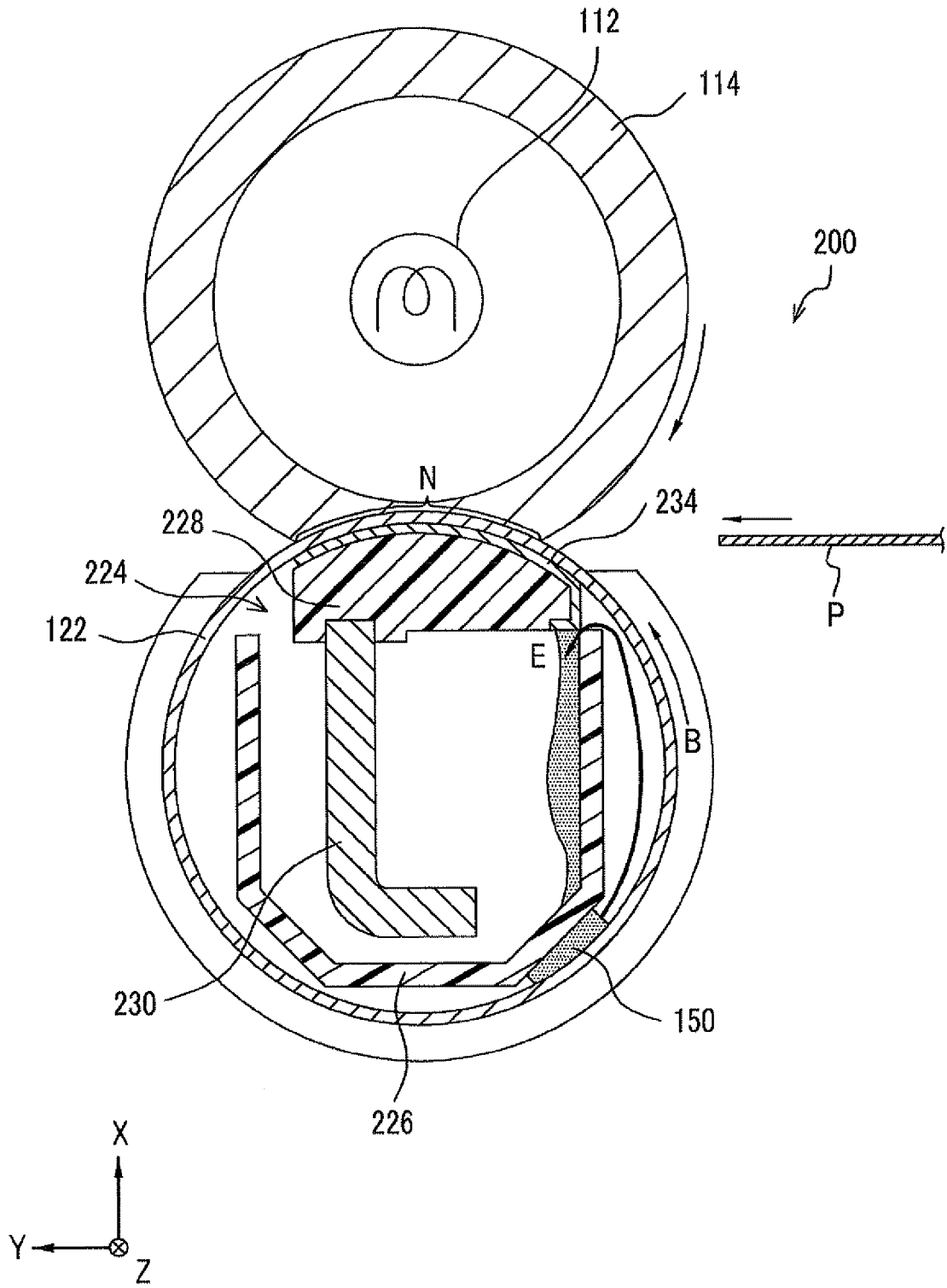
FIG. 12 is a sectional view illustrating a fixing device including a pressing member as a comparative example of the pressing member of the fixing device according to the exemplary embodiment of the invention.

FIG. 11A is a perspective view illustrating a pressing member 224 as a comparative example of the pressing member 124 according to the exemplary embodiment shown in FIG. 5 or the like. FIG. 11B is an exploded perspective view thereof. FIG. 12 is a sectional view illustrating a fixing device 200 having the pressing member 224 as the comparative example, similarly to FIG. 2.

As shown in FIG. 11B, the pressing member 224 is not an insert-molded product, but a module formed by assembling five parts of a guiding portion 226, a pressing portion 228, side portions 246, a metal plate 230, and a sheet member 234 which are provided as individual parts.

The guiding portion 226 of the pressing member 224 has a box shape of which the section has a U shape and plural ribs 222 coming in contact with the inner peripheral surface of the endless belt 122 are formed on the outer peripheral surface thereof. The metal plate 230 is received inside the guiding portion 226. The sheet member 234 is attached to the pressing portion 228 by allowing through-holes 236 formed at one end thereof to communicate with locking portions 262 formed in the pressing portion 228.

One of the guiding portion 226 and the side portions 246 of the pressing member 224 is formed of a resin material such as polyethylene terephthalate (PET) and the pressing portion 228 is formed of a material such as liquid crystal polymer (LCP) having higher strength than that of the polyethylene terephthalate (PET). The reason for forming the pressing portion 228 of the pressing member 224 out of a high-strength material is that the bending rigidity is required for the pressing portion 228.

On the contrary, in the pressing member 124 according to the exemplary embodiment, the pressing portion 128 is formed of polyethylene terephthalate (PET) but the pressing portion 128 has satisfactory bending rigidity by unifying the guiding portion 126, the pressing portion 128, the side portions 146, and the metal plate 130 by the insert molding.

The pressing member 124 according to the exemplary embodiment of the invention will be compared with the pressing member 224 as the comparative example with reference to FIGS. 2 and 12. In the pressing member 124, since the guiding portion 126 includes the first rib group 140 and the second rib group 142 of which the ribs extend from the elongated portion 138 at intervals in the direction of arrow Z, most of the metal plate 130 faces the inner peripheral surface of the endless belt 122. In other words, the pressing member 124 is insert-molded so as to have a part (exposed part 166 shown in FIGS. 7 and 8A) in which the metal plate 130 and the inner peripheral surface of the endless belt 122 face each other.

In the part in which the metal plate 130 and the inner peripheral surface of the endless belt 122 face each other, as indicated by arrow C in FIG. 2, a reflector effect is achieved in which radiation heat from the endless belt 122 is reflected by the surface of the metal plate 130 and is returned to the endless belt 122. Accordingly, the heat from the heating roller 110 is suppressed from being uselessly lost in the endless belt 122. That is, the heat of the endless belt 122 is effectively used by the reflector effect. On the contrary, in the pressing member 224, since the guiding portion 226 is formed in a box shape having a U-shaped section and the metal plate 230 is received therein as shown in FIG. 12, the part in which the metal plate 230 faces the inner peripheral surface of the endless belt 122 in the direction of arrow Z is not present. Accordingly, the reflector effect is not achieved in the pressing member 224.

In the pressing member 124, as indicated by arrow D in FIG. 2, most of the lubricant fed from the nonwoven fabric 150 is scrabbled at the position at which the sheet member 134 contacts the endless belt 122 and is returned to the nonwoven fabric 150. On the contrary, in the pressing member 224, as indicated by arrow E in FIG. 12, since the lubricant scrabbled at the position at which the sheet member 234 contacts the endless belt 122 enters the guiding portion 236 and some lubricant is not returned to the nonwoven fabric 150, the utilization ratio of the lubricant is lowered.

The amount of resin used in the pressing member 124 is lower by about 23% than the amount of resin used in the pressing member 224. The pressing portion 228 of the pressing member 224 is formed of expensive liquid crystal polymer (LCP). That is, the pressing member 124 is lower in material cost than the pressing member 224.

The pressing member 224 requires a work for assembling the five parts, but the pressing member 124 does not require the assembling work because the guiding portion 126, the pressing portion 128, the side portions 146, and the metal plate 130 and the sheet member 139 as the insert part are molded together. That is, the pressing member 124 is lower in assembling cost than the pressing member 224.

Incidentally, in the configuration of the pressing member 124 according to the exemplary embodiment, when seen from the cross-section facing the rotating direction of the heating roller 110 and the endless belt 122 as shown in FIG. 2, the center line L1 of a part of the metal plate 130 extending in the direction of arrow X is offset in the direction of arrow Y from the center line L2 including the rotation center of the heating roller 110 and the rotation center of the endless belt 122. This is because the largest pressing force is applied downstream from the center of the nip part N in the carrying direction of the recording sheet of paper P so as to improve the self detachability of the recording sheet of paper P passing through the nip part N and the pressing portion 128 is suppressed from being curved by disposing the metal plate 130 at the position where the largest pressing force is applied.

On the other hand, when the amounts of resin of both sides interposing the metal plate 130 are not equal to each other, the metal plate 130 is bent due to the difference in thermal contraction of the resin material at the time of insert molding. Accordingly, a connection portion 154 is provided to the first rib group 140 to compensate for the amount of resin on the side of the metal plate 130 offset from the center line L2. That is, in the pressing member 124, the mounts of resin of both sides interposing the center line L1 of the metal plate 130 are made to be equal to each other by providing the connection portion 154 to the first rib group 140, thereby suppressing the metal plate 130 from being bent. Here, "both sides (both sides of the metal plate 130) interposing the metal plate 130" represent the outside of a plane having the largest area and the outside of a plane facing the plane having the largest area, among plural planes of the metal plate 130.

Molding Machine

A molding machine 300 used to manufacture the pressing member 124 as the insert-molded product will be described with reference to FIGS. 14 to 20. In the following description, the vertical direction of the molding machine 300 is defined as a direction of arrow y, the horizontal direction thereof is defined as a direction of arrow x, and the depth direction thereof is defined as a direction of arrow z.

As shown in FIGS. 14 to 17, the molding machine 300 includes a mold 304 having a substantially cylindrical shape in a sectional view and having a cavity 302 elongated in the direction of arrow z. The mold 304 includes a fixed mold 306 fixed to a base (not shown) of the machine and a movable mold 308 moving in the direction of arrow x. A heater 310 connected to the fixed mold 306 and the movable mold 308 so as to heat the fixed mold 306 and the movable mold 308 is disposed outside the mold 304. Here, the heater 310 is a temperature adjusting device (temperature controller) controlling the mold 304 and a pinch member 318 to a predetermined temperature through the use of a medium (such as water and oil).

An injection port 312 used to inject molten resin (resin material) emitted from an injector (not shown) into the cavity is disposed in the fixed mold 306. Only one injection port 312 is disposed at a position at one end of the fixed mold 306 in the direction of arrow z facing the cavity 302.

A suction port 314 used to suction and fix the sheet member 134 to the wall is disposed in the fixed mold 306. Plural suction ports 314 are disposed at intervals in the direction of arrow z (only one is shown in the drawing), and the sheet member 134 is suctioned and fixed to the fixed mold 306 so that the longitudinal direction thereof is parallel to the direction of arrow z and one end thereof in the transverse direction (the direction of arrow y) is inserted into the cavity 302.

Figure 17:
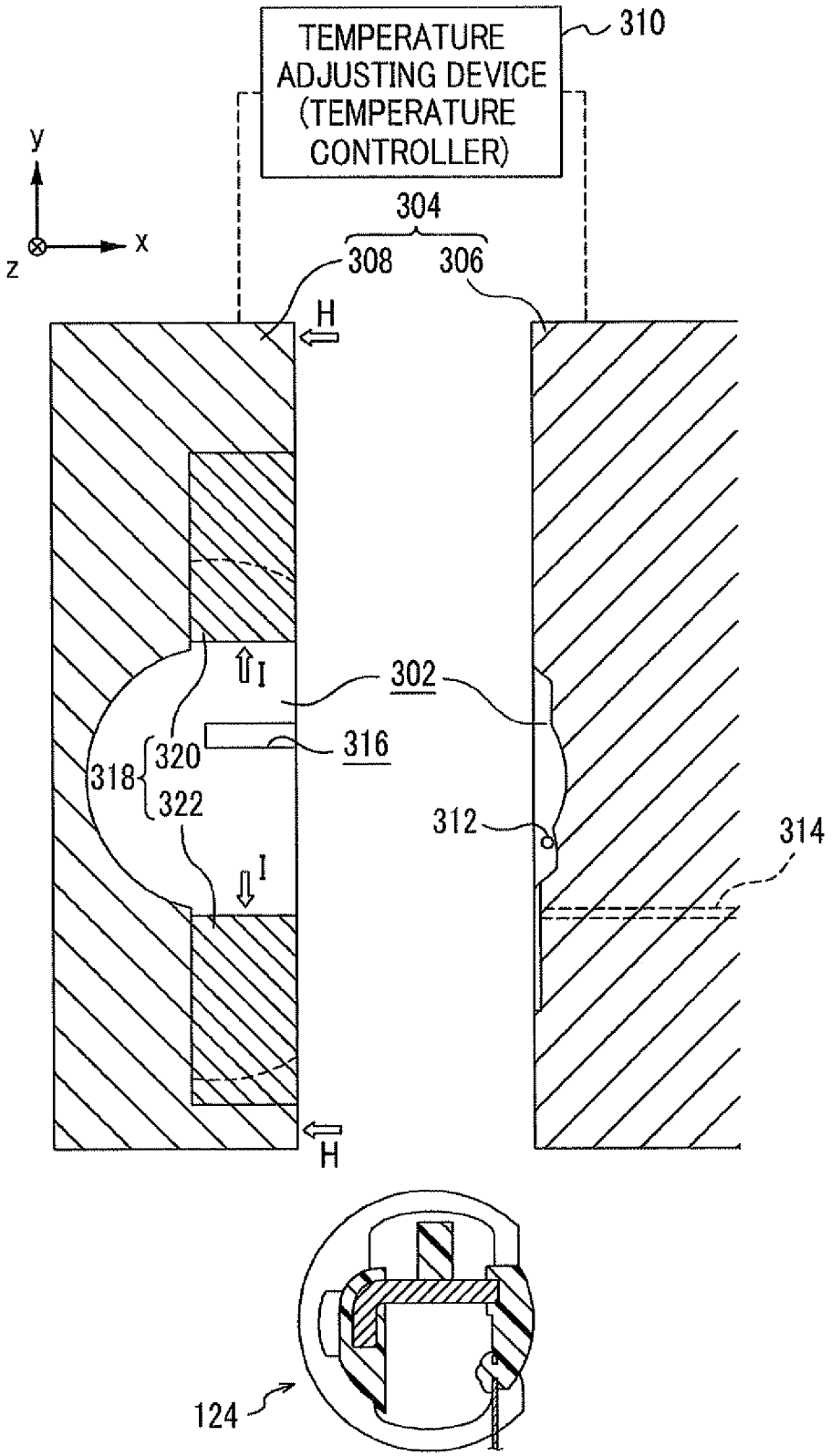
FIG. 17 is a sectional view illustrating the mold in a state where the mold shown in FIG. 16 is opened and the pressing member as an insert-molded product is taken out.

A positioning groove 316 (see FIGS. 14 and 17) used to position the metal plate 130 in the cavity 302 is disposed in the movable mold 308. The positioning groove 316 is disposed at both ends of the movable mold 308 in the direction of arrow z (only one is shown in FIGS. 14 and 17).

Figure 14:
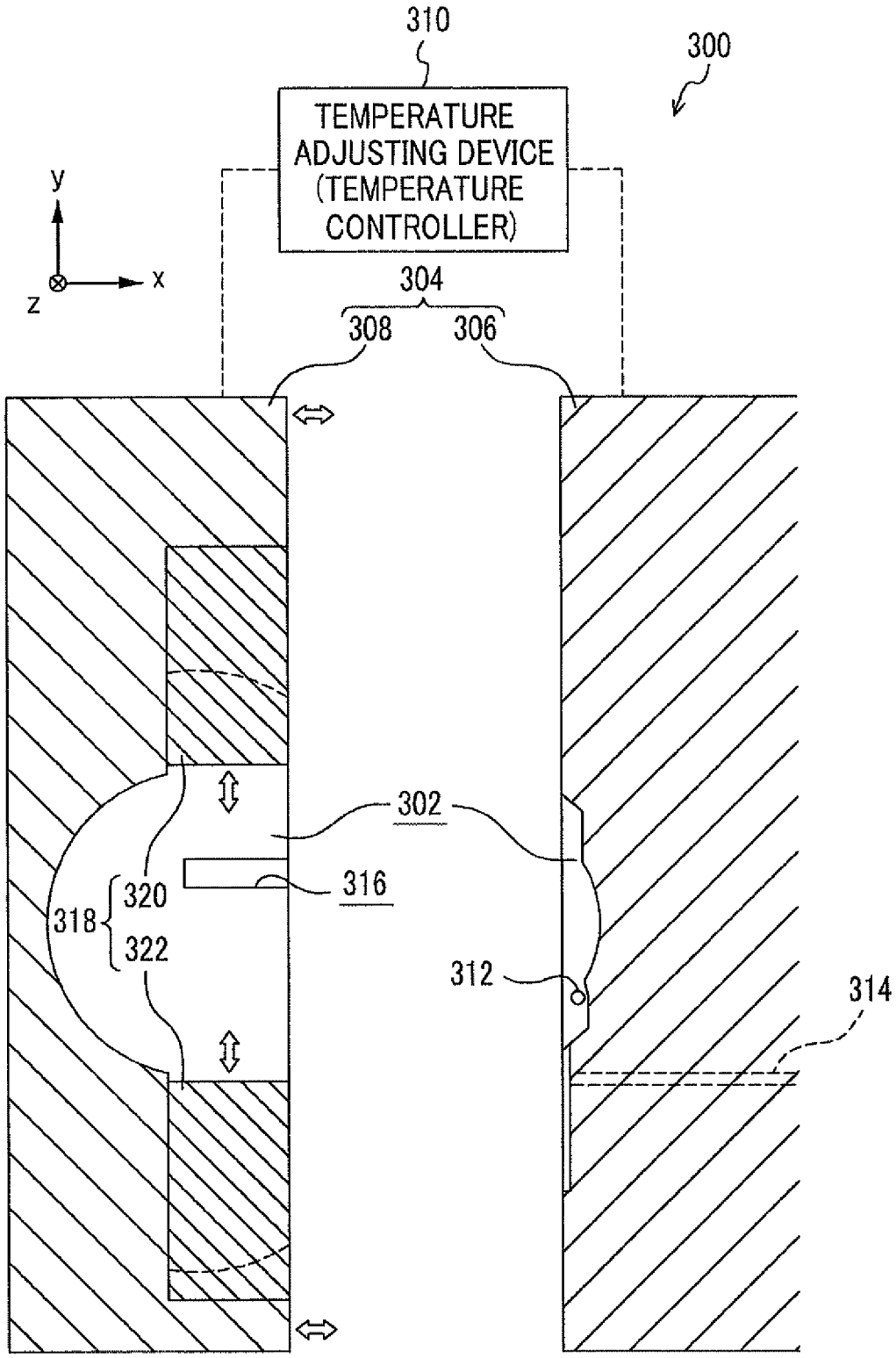
FIG. 14 is a sectional view illustrating a mold used to manufacture the pressing member of the fixing device according to the exemplary embodiment of the invention.
Figure 15:
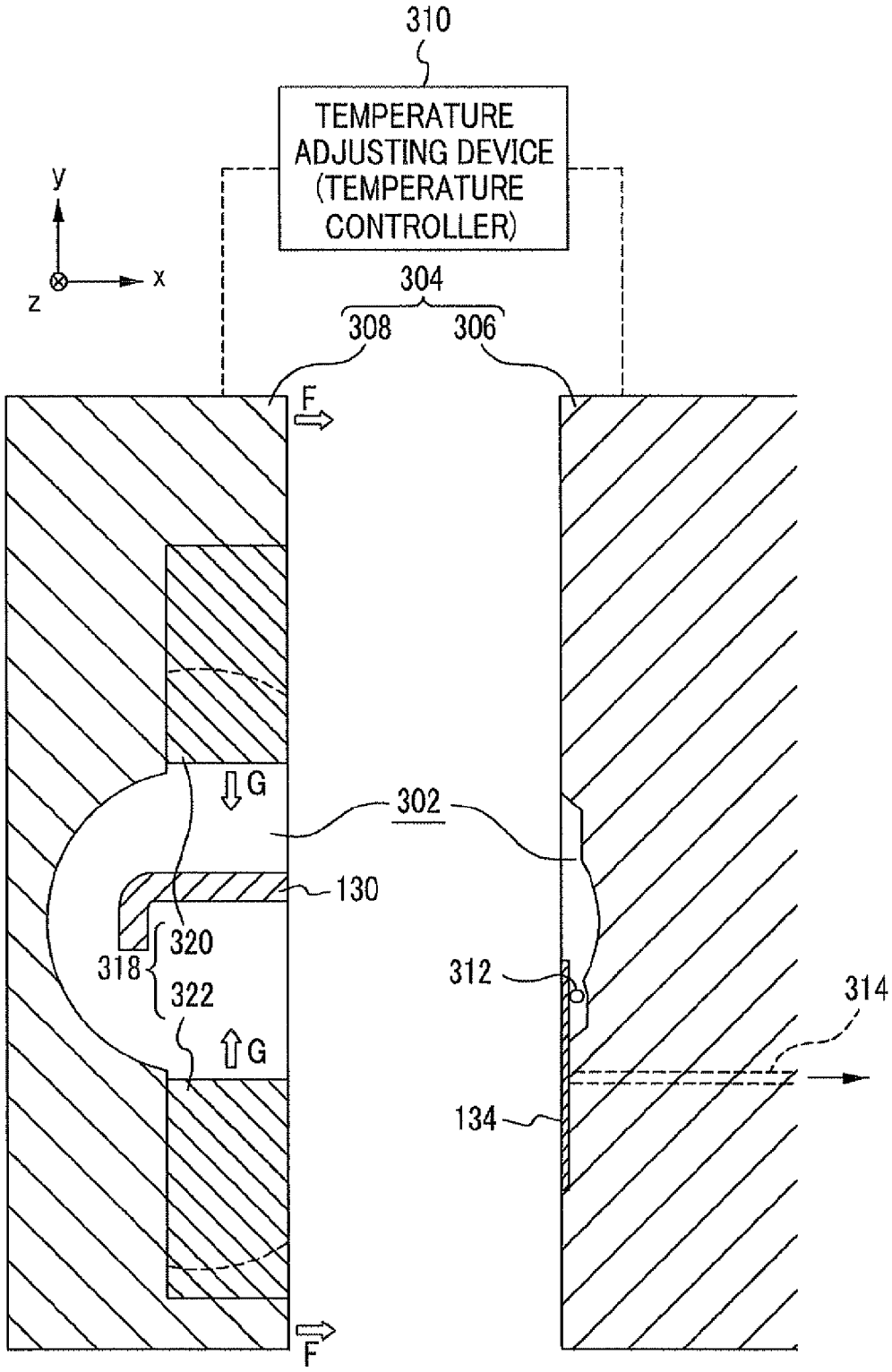
FIG. 15 is a sectional view illustrating the mold in a state where a metal plate and a sheet member as insert parts are set in the mold shown in FIG. 14.

As shown in FIGS. 14 and 15, the metal plate 130 is positioned in the cavity 302 by inserting protrusions 132 of the metal plate 130 into the positioning grooves 316 so that the longitudinal direction thereof is parallel to the longitudinal direction (direction of arrow z) of the cavity 302.

A pinch member 318 movable in the direction of arrow y is disposed in the movable mold 308. The pinch member 318 includes an upper movable core 320 and a lower movable core 322. As shown in FIG. 15, the upper movable core 320 and the lower movable core 322 move in a pinch direction G in which the metal plate 130 is pinched with the movement of the movable mold 308 in a clamping direction F. As shown in FIG. 17, the upper movable core 320 and the lower movable core 322 move in an anti-pinch direction I in which the metal plate 130 is not pinched with the movement of the movable mold 308 in an opening direction H.

Figure 16:
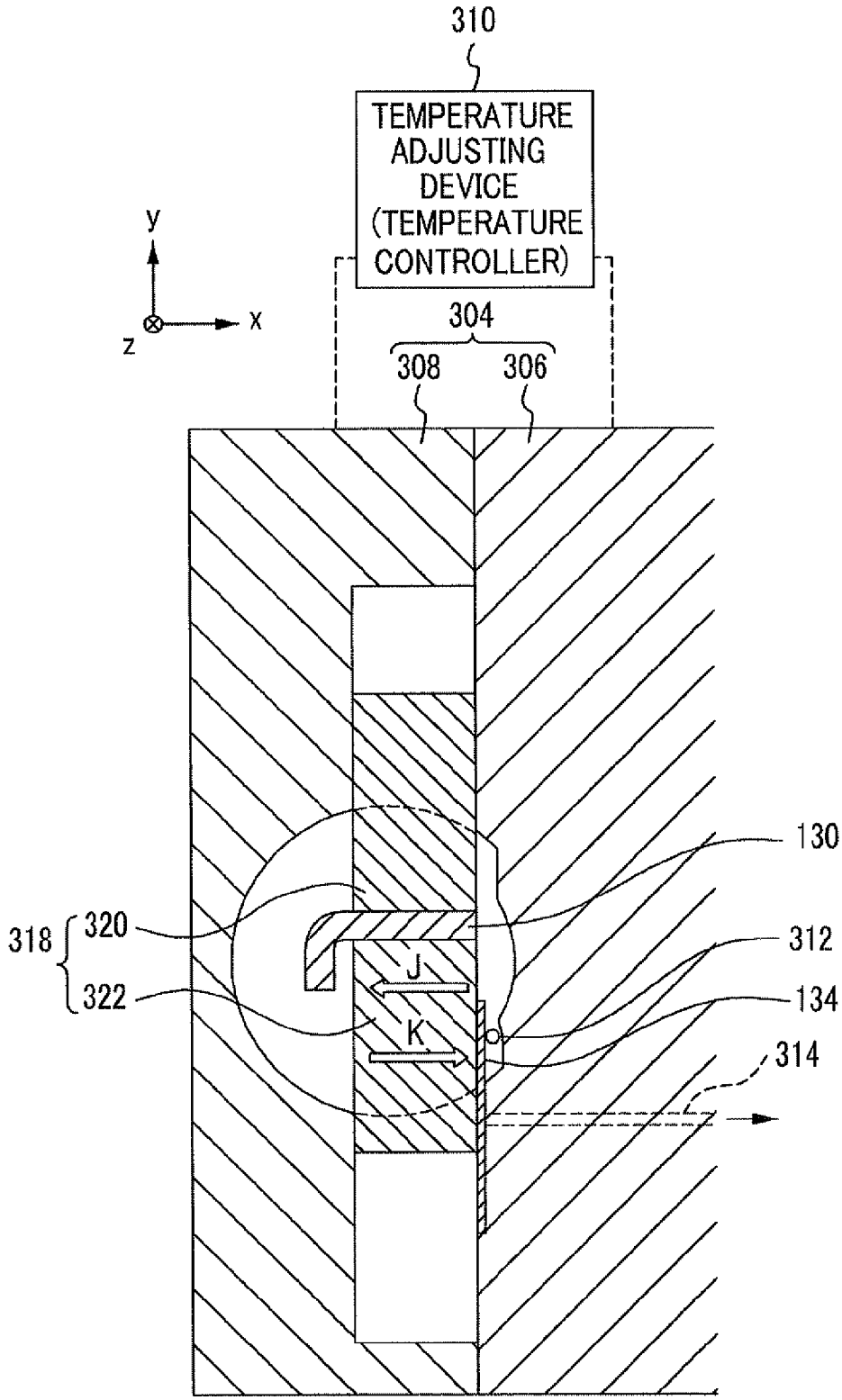
FIG. 16 is a sectional view illustrating the mold in a state where the mold shown in FIG. 15 is clamped.

As shown in FIG. 16, the metal plate 130 is pinched by the pinch member 318 at a position offset from the center of the cavity 302, when seen in the cross-section (the section in the transverse direction of the cavity 302) of the cavity 302. In other words, the center of the cavity 302 is the rotation center (designed value) of the endless belt 122 when it is assumed that the endless belt 122 is fitted to the insert-molded product (the pressing member 124) insert-molded in the cavity 302. A resin material is injected into the cavity 302 in a state where the metal plate 130 is pinched by the pinch member 318. As described above, in order to suppress the metal plate 130 from being bent due to the difference in thermal contraction of the resin material at the time of insert molding, the shapes of the fixed mold 306, the movable mold 308, the upper movable core 320, and the lower movable core 322 are determined so that the amounts of resin materials of both sides interposing the metal plate 130 in the cavity 302 are equal to each other.

Figure 18:
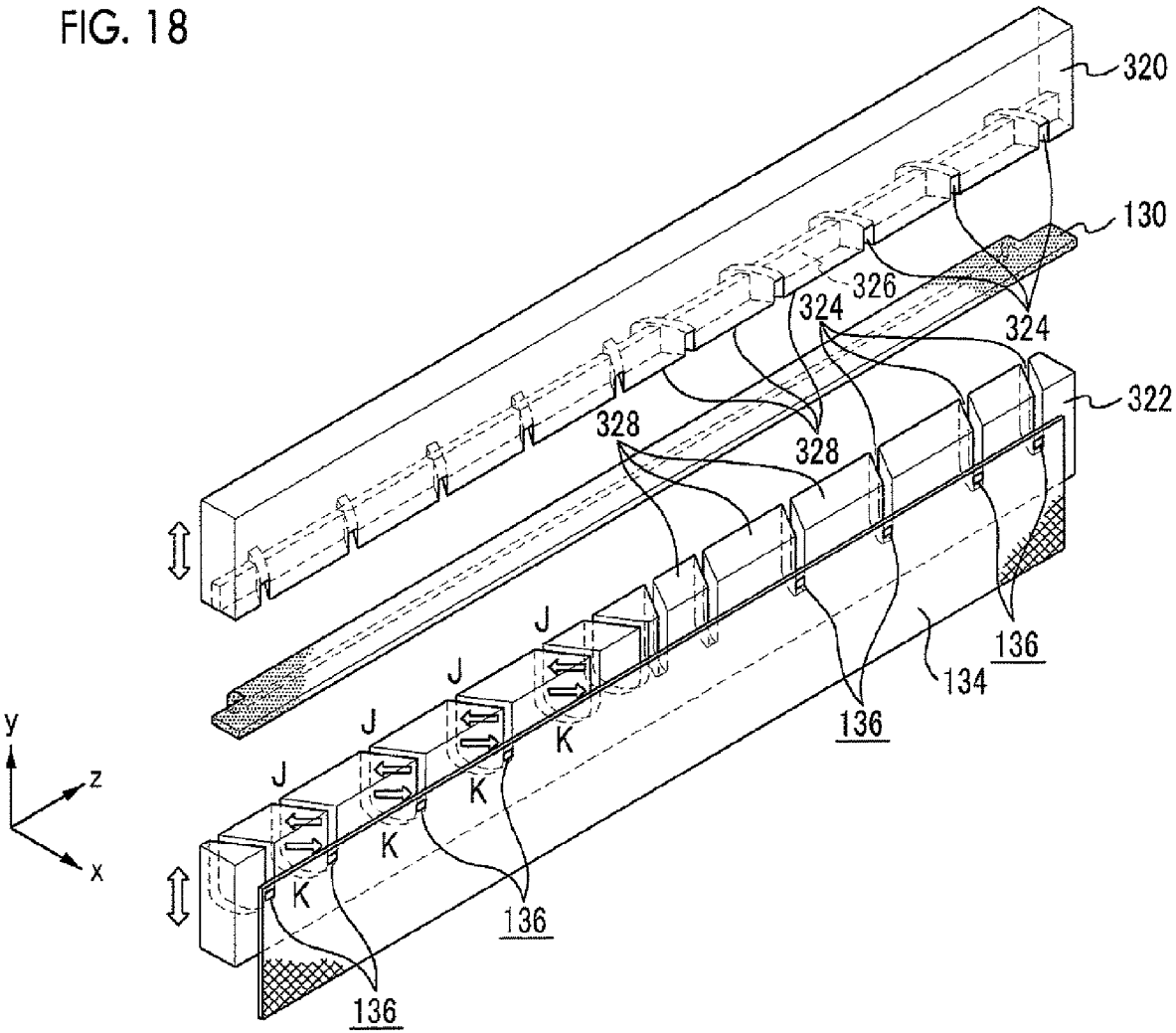
FIG. 18 is a perspective view illustrating a pinch member of the mold shown in FIG. 14.

Specifically, as shown in FIG. 18, rib grooves 324 used to form the first rib group 140 and the second rib group 142 are formed in the upper movable core 320 and the lower movable core 322, and a connection portion groove 326 used to form the connection portion 154 is formed in the upper movable core 320. By providing the connection portion groove 326, the amounts of resin material of both sides interposing the metal plate 130 are made to be equal to each other in the cavity 302.

As shown in FIG. 18, the upper movable core 320 and the lower movable core 322 pinch the metal plate 130 through the use of plural pinch portions 328 divided in the longitudinal direction (the direction of arrow z) of the cavity 302 by the rib grooves 324 (the upper movable core 320 is further divided in the transverse direction (the direction of arrow x) by the connection portion groove 326). The pinch portions 328 of the upper movable core 320 and the lower movable core 322 pinch the metal plate 130 so as to press up the metal plate 130 (to reduce the thickness of the metal plate 130). In other words, when clamping the mold 304, the moving distance in the pinching direction G of the upper movable core 320 and the lower movable core 322 is set to press up the metal plate 130 (to reduce the thickness of the metal plate 130). Accordingly, the resin material is not infiltrated between the pinch portions 328 and the metal plate 130 and thus the formation of burrs is suppressed.

As shown in FIGS. 16 and 18, one end of the sheet member 134 in the transverse direction (the direction of arrow y) is inserted into the cavity 302 across the plural pinch portions 328 of the lower movable core 322 in the direction of arrow z. The sheet member 134 is disposed so that the through-holes 136 are matched with the rib grooves 324 in the direction of arrow z.

The relationship between the rolling-up of the sheet member 134 and the flow of the resin material injected from the injection port 312 will be described below.

Figure 19A:
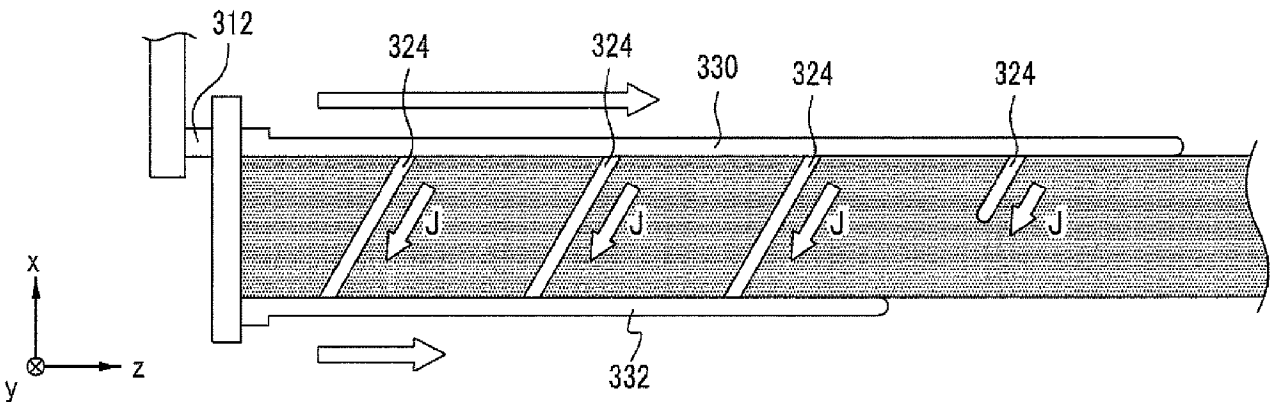
FIGS. 19A and 19B are diagrams illustrating a flow of a molten resin.
Figure 20A:
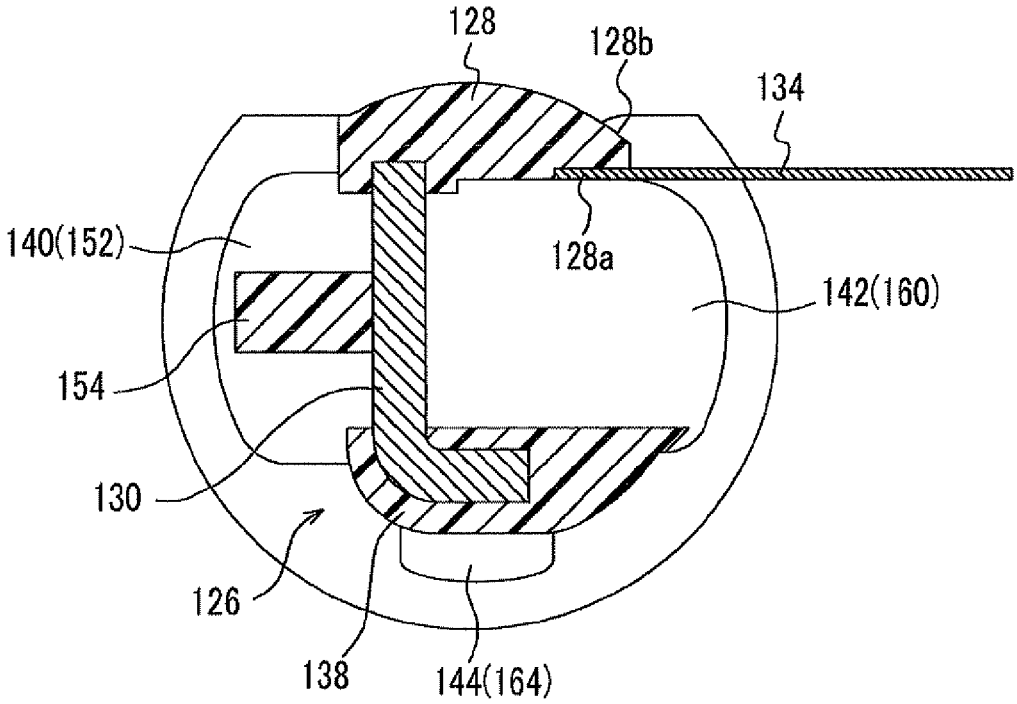
FIG. 20A is a sectional view illustrating the pressing member when the sheet member is unified by the insert molding and FIG. 20B is a sectional view illustrating the pressing member in a state where the sheet member is rolled up to the outside surface of the pressing portion and is not unified by the insert molding.

As shown in FIG. 19A, when the flow of the resin material flowing in a pressing-portion corresponding portion 330 in the cavity 302 is faster than the flow of the resin material flowing in an elongated-portion corresponding portion 332, the resin material passes through the rib grooves 324 from the pressing-portion corresponding portion 330 to the elongated-portion corresponding portion 332 as indicated by arrow J in FIGS. 16, 18, and 19A. In this case, a force in the direction in which it is pressed against the plural pinch portions 328 is added to the sheet member 134. As a result, as shown in FIG. 20A, the sheet member 134 in the insert-molded pressing member 124 is held between the inside surface 128*a* of the pressing portion 128 and the second rib group 142 without being rolled up toward the outside surface 128*b* of the pressing portion 128 and is unified therewith.

Figure 19B:
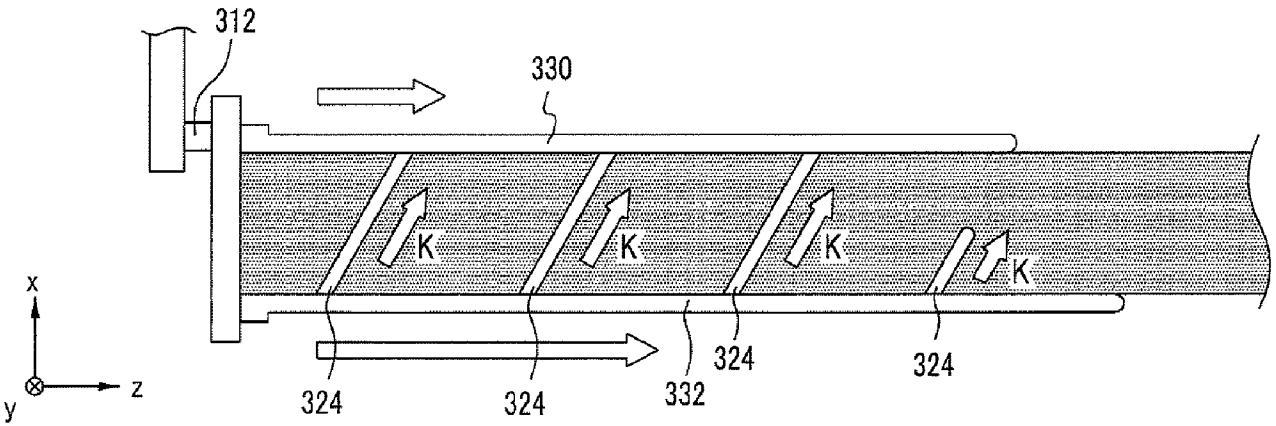
Figure 20B:
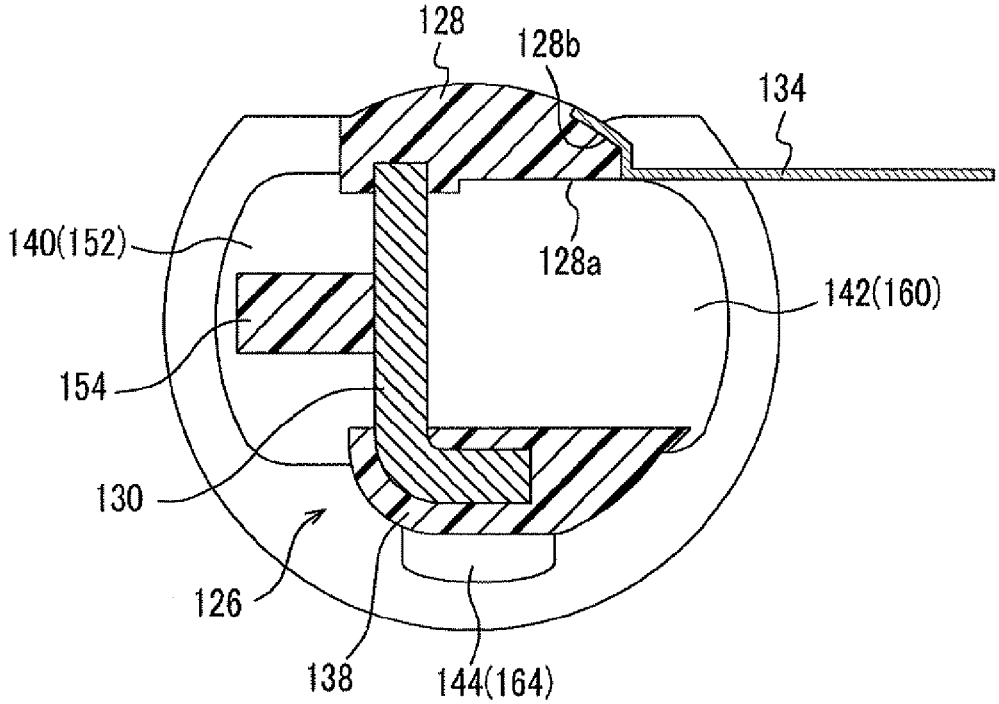

On the other hand, as shown in FIG. 19B, when the flow of the resin material flowing in the pressing-portion corresponding portion 330 in the cavity 302 is slower than the flow of the resin material flowing in the elongated-portion corresponding portion 332, the resin material passes through the rib grooves 324 from the elongated-portion corresponding portion 332 to the pressing-portion corresponding portion 330 as indicated by arrow K in FIGS. 16, 18, and 19B. In this case, a force in the direction in which it is separated from the plural pinch portions 328 is added to the sheet member 134. As a result, as shown in FIG. 20B, the sheet member 134 in the insert-molded pressing member 124 is rolled up to the outside surface 128*b* of the pressing portion 128 and thus is not unified therewith.

Here, the injection port 312 of the molding machine 300 according to the exemplary embodiment is disposed in the fixed mold 306. That is, since the injection port 312 is disposed on the opposite side to plural pinch portions 328 about the sheet member 134, the direction in which the resin material injected from the injection port 312 passes through the rib grooves 324 is the same as indicated by arrow L1 and the force in the direction in which it is pressed against the plural pinch portions 328 is added to the sheet member 134. Accordingly, as shown in FIG. 20A, the sheet member 134 in the insert-molded pressing member 124 is held between the inside surface 128*a* of the pressing portion 128 and the second rib group 142 without being rolled up to the outside surface 128*b* of the pressing portion 128 and is thus unified therewith.

Method of Manufacturing Insert-Molded Product

A method of manufacturing the pressing member 124 as an insert-molded product will be described below with reference to FIGS. 14 to 17 and FIG. 21.

Figure 21:
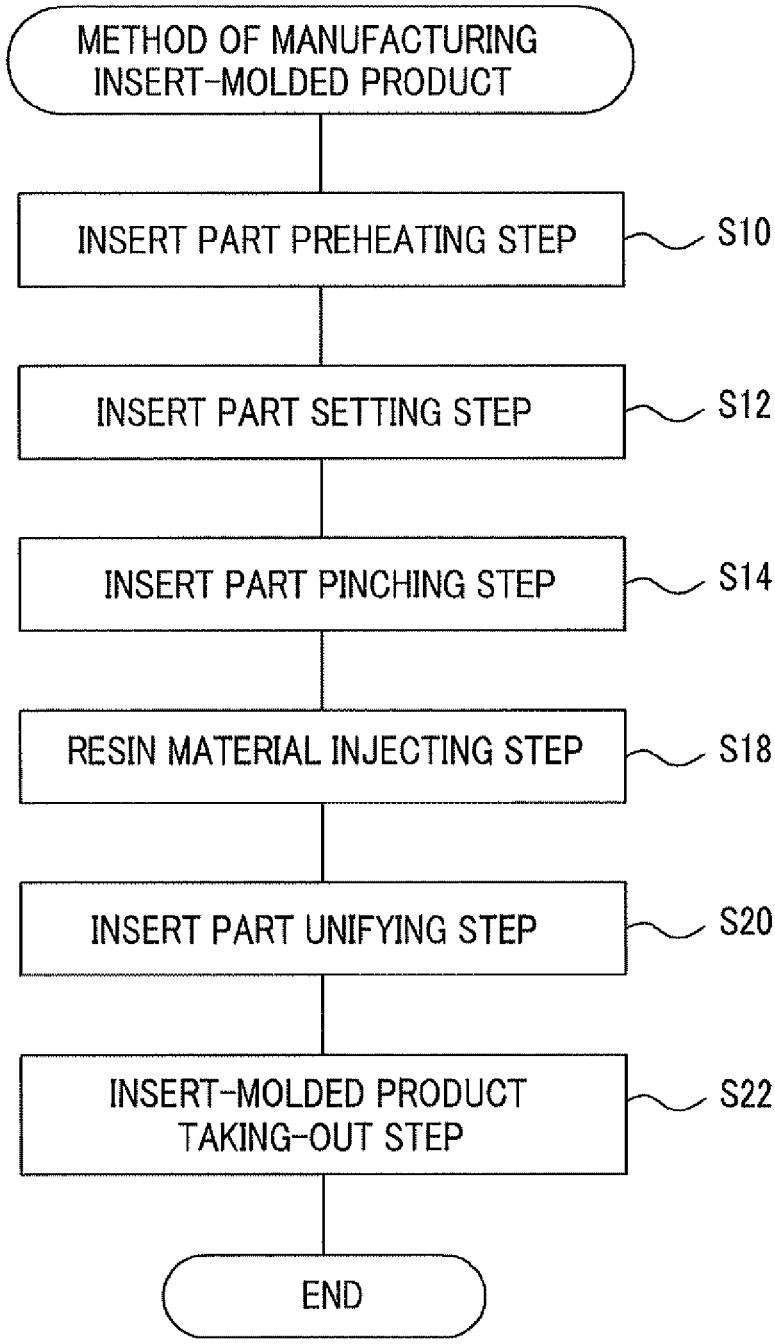
FIG. 21 is a flowchart illustrating a method of manufacturing the pressing member as an insert-molded product.

As shown in FIG. 21, the metal plate 130 as an insert part is first preheated in 310 (metal plate heating step). This preheating step is performed through the use of a heater (not shown) provided separately from the molding machine 300 before setting the metal plate 130 in the cavity 302. The metal plate 130 is preheated up to the same temperature (for example, 120° C.) as the mold 304. Here, the same temperature includes a case where the temperature of the metal plate 130 is considered as being substantially equal to the temperature of the mold 304, as well as a case where the temperature of metal plate 130 is equal to the temperature of the mold 304.

Then, in S12, the metal plate 130 and the sheet member 134 as the insert parts are set in the mold 304. Specifically, as shown in FIGS. 14 and 15, the protrusions 132 of the metal plate 130 are inserted into the positioning grooves 316 formed in the movable mold 308 and the metal plate 130 is set into the mold 304. The sheet member 134 is suctioned and fixed to the wall of the fixed mold 306 so as to insert one end of the sheet member 134 into the cavity 302, and the sheet member 134 is set into the mold 304.

In S14, the metal plate 130 and the sheet member 134 as the insert parts are pinched by the mold 304 (pinching step). Specifically, as shown in FIGS. 15 and 16, by causing the movable mold 308 to move to the fixed mold 306 and clamping the molds, the metal plate 130 is pinched by the upper movable core 320 and the lower movable core 322 and the sheet member is pinched between the lower movable core 322 and the fixed mold 306.

In this case, since the metal plate 130 is heated to the same temperature as the mold 304 in the metal plate heating step, the metal plate 130 and the mold 304 have the same temperature at the end of the pinching step. The reason for heating the metal plate 130 up to the same temperature as the mold 304 will be described later, but the metal plate heating step may be performed after the pinching step as long as the metal plate 130 and the mold 304 are made to have the same temperature. That is, in S12, the protrusions 132 of the metal plate 130 as the insert part are inserted into the positioning grooves 316 formed in the movable mold 308 and the sheet member 134 is suctioned and fixed to the wall of the fixed mold 306 so as to insert one end of the sheet member 134 into the cavity 302. Thereafter, in S14, the metal plate 130 and the sheet member 134 as the insert parts are pinched by the mold 304 (pinching step). Since the fixed mold 306 and the movable mold 308 are controlled to a constant temperature, for example, 120° C. (predetermined temperature), by the heater 310, the metal plate 130 is also heated to 120° C. by the thermal conduction from the fixed mold 306 and the movable mold 308 via the upper movable core 320 and the lower movable core 322 as the pinch member 318.

In S18, molten resin (resin material) is injected (injection step). Specifically, the molten resin emitted from the injector (not shown) is injected into the cavity 302 via the injection port 312 and the cavity 302 is filled with the molten resin.

In S20, the metal plate 130 and the sheet member 134 as the insert parts are unified (unifying step). Specifically, by adjusting the temperature of the fixed mold 306 and the movable mold 308 up to a constant temperature (for example, 120° C.) through the use of the heater 310, the molten resin, for example, at a temperature of 300° C. is cooled to 120° C. and solidified to unify the metal plate 130 and the sheet member 134 as the insert-molded product.

In S22, the pressing member 124 as the insert-molded product is taken out from the cavity 302 (taking-out step). Specifically, as shown in FIG. 17, by causing the movable mold 308 to move so as to be separated from the fixed mold 306 and opening the mold, the upper movable core 320 and the lower movable core 322 are made to move in the anti-pinching direction I and the pressing member 124 as the insert-molded product is taken out from the cavity 302.

As described above, since the molten resin is injected into the cavity 302 after the metal plate 130 is heated in advance or after the metal plate 130 and the mold 304 are heated to the same temperature through the use of heat of the mold 304, the molten resin filled in the cavity 302 is uniformly cooled at the time of cooling and solidifying the molten resin, thereby suppressing the cooling deformation from being generated between the resin material coming in contact with the metal plate 130 and the resin material not coming in contact with the metal plate 130. Accordingly, the deformation is suppressed from being generated after taking out the pressing member 124 from the cavity 302, thereby improving the formation precision of the pressing member 124.

The image forming apparatus 10 according to the exemplary embodiment of the invention is of a type of having the intermediate transfer belt 14 and performing a primary transfer process and a secondary transfer process, but the invention may be applied to an image forming apparatus of a type of directly transferring a toner image held by the photosensitive drum 16 to a recording sheet of paper P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with various modifications as are suited to the particular use contemplated. It is intended that the scope of the invention be defined by the following claims and their equivalents.

What is claimed is:

1. A fixing device comprising:

a heat source;

a roller that is heated by the heat source;

an endless belt that contacts the roller and rotates along with a rotation of the roller;

a guiding portion that includes a first resin member being disposed inside the endless belt and guiding a rotation of the endless belt;

a second resin member being disposed inside the endless belt and pressing the endless belt on the roller; and a plate member that includes an elongated metal member of which the longitudinal direction is arranged to be parallel to a rotation axis of the roller, a first end and a second end of the elongated metal member in the transverse direction being unified with the first resin member and the second resin member, respectively, the second end of the elongated member being disposed within a groove formed in the second resin member, wherein the elongated metal member has a part facing the inner surface of the endless belt.

2. The fixing device according to claim 1, wherein the second resin member has an elongated shape, a longitudinal direction of the second resin member being arranged to be parallel to the longitudinal direction of the plate member, and the first resin member has an elongated shape, a longitudinal direction of the first resin member being arranged to be parallel to the longitudinal direction of the plate member, the fixing device further comprising a plurality of ribs that are arranged at intervals in the longitudinal direction of the plate member, each of the plurality of ribs extending from one of the first resin member and the second member toward the other one of the first resin member and the second member and being fixed to only one of the first resin member and the second resin member.

3. The fixing device according to claim 2, wherein the thickness of the second resin member at the center in the longitudinal direction is greater than that at the ends thereof, and the ribs disposed around the center in the longitudinal direction of the second resin member among the plurality of ribs are fixed to the elongated portion of the first resin member.

4. The fixing device according to claim 1, wherein a sheet member to be disposed between the second resin member and the inner peripheral surface of the endless belt is fixed to the first resin member, the second resin member, and the plate member.

5. The fixing device according to claim 1, wherein the plate member includes a straight portion connecting the first resin member and the second resin member and the straight member is disposed at a position offset from the center straight line connecting the rotation center of the roller and the rotation center of the endless belt when the fixing device is seen from a cross-section facing the rotation direction of the roller and the endless belt.

6. The fixing device according to claim 5, the fixing device further comprising a plurality of ribs that are arranged at intervals in the longitudinal direction of the plate member, each of the plurality of ribs extending from one of the first resin member and the second member toward the other one of the first resin member and the second member and being fixed to only one of the first resin member and the second resin member, wherein amounts of resin used in the first resin member, the second resin member, and the plurality of ribs existing on both sides of the straight portion of the metal plate are equal.

7. An image forming apparatus comprising:

an image holding member on which an electrostatic latent image is formed;

a developing device that develops the electrostatic latent image formed on the image holding member through the use of toner;

a transfer device that transfers a toner image developed by the developing device onto a transfer target member; and the fixing device according to claim 1 that fixes the toner image transferred onto the transfer target member to the transfer target member.

8. An image forming apparatus comprising:

an image holding member on which an electrostatic latent image is formed;

a developing device that develops the electrostatic latent image formed on the image holding member through the use of toner;

a transfer device that transfers a toner image developed by the developing device onto a transfer target member; and the fixing device according to claim 2 that fixes the toner image transferred onto the transfer target member to the transfer target member.

* * * * *